US009962049B2

(12) United States Patent
Thorne

(10) Patent No.: US 9,962,049 B2
(45) Date of Patent: May 8, 2018

(54) SURFACE CLEANING APPARATUS

(71) Applicant: SharkNinja Operating LLC, Newton, MA (US)

(72) Inventor: Jason Boyd Thorne, Dover, MA (US)

(73) Assignee: SharkNinja Operating LLC, Needham, MA (US)

( * ) Notice: Subject to any disclaimer, the term of this patent is extended or adjusted under 35 U.S.C. 154(b) by 798 days.

(21) Appl. No.: 14/297,772

(22) Filed: Jun. 6, 2014

(65) Prior Publication Data

US 2015/0351596 A1 Dec. 10, 2015

(51) Int. Cl.

| | |
|---|---|
| ***A47L 5/28*** | (2006.01) |
| ***A47L 5/30*** | (2006.01) |
| ***A47L 5/22*** | (2006.01) |
| ***A47L 5/26*** | (2006.01) |
| ***A47L 9/32*** | (2006.01) |
| ***A47L 9/00*** | (2006.01) |
| ***A47L 9/16*** | (2006.01) |
| *A47L 9/20* | (2006.01) |

(52) U.S. Cl.

CPC ..... *A47L 5/28* (2013.01); *A47L 5/225* (2013.01); *A47L 5/26* (2013.01); *A47L 5/30* (2013.01); *A47L 9/0072* (2013.01); *A47L 9/16* (2013.01); *A47L 9/322* (2013.01); *A47L 9/325* (2013.01); *A47L 9/327* (2013.01); *A47L 9/20* (2013.01)

(58) Field of Classification Search

CPC ... A47L 9/16; A47L 9/165; A47L 5/28; A47L 9/0072

USPC ..... 15/344, 351, 353

See application file for complete search history.

(56) References Cited

U.S. PATENT DOCUMENTS

| | | | |
|---|---|---|---|
| D315,043 | S | 2/1991 | Hayden |
| D333,023 | S | 2/1993 | Herron, Jr. |
| D334,447 | S | 3/1993 | Rohn |
| 5,224,237 | A | 7/1993 | Ambrosiano |
| 5,584,095 | A | 12/1996 | Redding et al. |
| 5,747,764 | A | 5/1998 | Son et al. |
| 5,794,305 | A | 8/1998 | Weger |
| 6,055,703 | A | 5/2000 | Redding et al. |
| D431,335 | S | 9/2000 | Mehaffey et al. |
| D510,465 | S | 10/2005 | Takahashi et al. |
| D543,325 | S | 5/2007 | Burnham |
| D565,266 | S | 3/2008 | Crevling et al. |
| D573,759 | S | 7/2008 | Konno et al. |
| D580,116 | S | 11/2008 | Santiago et al. |
| D587,870 | S | 3/2009 | Baek et al. |
| 7,503,098 | B2 | 3/2009 | Stein |
| 7,581,284 | B2 | 9/2009 | Courtney |

(Continued)

FOREIGN PATENT DOCUMENTS

| | | |
|---|---|---|
| CA | 2697025 A1 | 2/2004 |
| CA | 2495053 | 10/2010 |

(Continued)

OTHER PUBLICATIONS

PCT Search Report and Written Opinion dated Sep. 14, 2015, received in corresponding PCT Application No. PCT/US15/034506, 10 pgs.

*Primary Examiner* — Michael Jennings

(74) *Attorney, Agent, or Firm* — Grossman Tucker Perreault & Pfleger, PLLC

(57) ABSTRACT

A surface cleaning apparatus is provided with a brush drive motor control and/or a bleed valve control is provided on a handle assembly.

19 Claims, 15 Drawing Sheets

(56) References Cited

U.S. PATENT DOCUMENTS 7,581,285 B2 9/2009 Courtney
7,600,292 B2 10/2009 Courtney
7,610,653 B2 11/2009 Courtney
D608,064 S 1/2010 Conrad et al.
D611,210 S 3/2010 Conrad et al.
7,757,343 B2 7/2010 Courtney
7,805,804 B2 10/2010 Loebig
7,823,251 B2 11/2010 Dyson et al.
7,854,039 B2 12/2010 Lee et al.
D633,264 S 2/2011 Lee
D641,114 S 7/2011 Choi et al.
D642,755 S 8/2011 Fjellman
D644,385 S 8/2011 Hare et al.
8,032,983 B2 10/2011 Griffith et al.
D662,271 S 6/2012 Conrad et al.
D662,272 S 6/2012 Conrad et al.
D670,056 S 10/2012 Ventress et al.
D680,288 S 4/2013 Bilger et al.
D684,326 S 6/2013 Okabe et al.
D685,961 S 7/2013 Bilger et al.
D686,377 S 7/2013 Thorne
D693,975 S 11/2013 Santiago et al.
D695,980 S 12/2013 Thorne
8,689,395 B2 * 4/2014 Conrad ..... A47L 9/0036 15/323
9,009,913 B2 * 4/2015 Wills ..... A47L 5/32 15/350
2002/0189046 A1 * 12/2002 Nighy ..... A47L 9/327 15/327.1
2005/0198764 A1 * 9/2005 Heatley ..... A47L 9/0036 15/323
2006/0085943 A1 * 4/2006 Gammack ..... A47L 5/362 15/323
2009/0056058 A1 3/2009 Finke et al.
2009/0056059 A1 3/2009 Mersmann et al.
2009/0056061 A1 3/2009 Andrup et al.
2011/0107553 A1 5/2011 Myers
2011/0219573 A1 9/2011 Conrad
2011/0219575 A1 * 9/2011 Conrad ..... A47L 5/225 15/347
2011/0219577 A1 * 9/2011 Conrad ..... A47L 5/225 15/347
2011/0219579 A1 * 9/2011 Conrad ..... A47L 5/28 15/352
2011/0219581 A1 9/2011 Vines et al.
2012/0222259 A1 * 9/2012 Conrad ..... A47L 9/327 15/347
2014/0237754 A1 8/2014 Conrad
2014/0237759 A1 * 8/2014 Conrad ..... A47L 9/16 15/344
2014/0237762 A1 8/2014 Conrad
2014/0237767 A1 * 8/2014 Conrad ..... A47L 9/2857 15/353
2014/0259519 A1 * 9/2014 Conrad ..... A47L 5/225 15/329

FOREIGN PATENT DOCUMENTS

CA 2495066 5/2011
CA 2495073 5/2011
CA 2718836 A1 5/2011

* cited by examiner

SURFACE CLEANING APPARATUS

FIELD

This specification relates to a surface cleaning apparatus. In one embodiment, the surface cleaning apparatus has a brush control provided on or adjacent the handle assembly so that a user may adjust the brush speed while operating the surface cleaning apparatus. Alternately, or in addition, in other embodiments, the surface cleaning apparatus has a bleed valve control provided on or adjacent the handle assembly so that a user may adjust the amount of bleed air admitted while operating the surface cleaning apparatus.

INTRODUCTION

The following is not an admission that anything discussed below is part of the prior art or part of the common general knowledge of a person skilled in the art.

Various types of surface cleaning apparatus are known. Typically, an upright vacuum cleaner includes an upper portion or upper section, including an air treatment member such as one or more cyclones and/or filters, drivingly mounted to a surface cleaning head. An up flow conduit is typically provided between the surface cleaning head and the upper portion. In some such vacuum cleaners, a spine, casing or backbone extends between the surface cleaning head and the upper portion for supporting the air treatment member. The suction motor may be provided in the upper portion or in the surface cleaning head.

Surface cleaning apparatus having a portable cleaning module that is removably mounted to an upright vacuum cleaner are known. See for example U.S. Pat. No. 5,309,600, U.S. Pat. No. 4,635,315 and US 2011/0314629. US 2011/0314629 discloses an upright vacuum cleaner having a surface cleaning head and an upright section pivotally mounted thereto. A hand vacuum cleaner or a pod is removably mounted on the upper portion and is connected in airflow communication with the surface cleaning head via a flexible hose. A portion of the upper portion is bendable so as to allow the surface cleaning head to extend under furniture. This bendable portion is external to the airflow path. In use, the hand vacuum cleaner is locked on the upper portion. A user may manually unlock the hand vacuum cleaner so as to remove it for use as a hand vacuum cleaner and/or for emptying the cyclone bin assembly. In addition, an above floor cleaning wand may be provided and may be removable with the pod.

SUMMARY

This summary is intended to introduce the reader to the more detailed description that follows and not to limit or define any claimed or as yet unclaimed invention. One or more inventions may reside in any combination or sub-combination of the elements or process steps disclosed in any part of this document including its claims and figures.

In a first aspect there is provided a reconfigurable surface cleaning apparatus wherein the handle assembly is provided with a bleed valve. Reconfigurable vacuum cleaners are operable in various modes (e.g., one or more floor cleaning modes, one or more above floor cleaning modes). In some modes, such as when cleaning an area rug, some bleed air may be required to reduce the air flow at the surface cleaning head inlet. Accordingly, the bleed valve may be provided in the handle assembly so as to admit bleed air upstream of the air treatment member. If the air treatment member is a cyclone, then admitting bleed air through the handle will enable essentially the same flow rate of air to enter the cyclone while reducing the air flow at the surface cleaning head inlet. Accordingly, the cyclonic flow pattern in the cyclone is not affected.

In accordance with this aspect, there is provided a surface cleaning apparatus having comprising:

(a) a surface cleaning head having a dirty air inlet;
(b) an upper portion moveably mounted to the surface cleaning head between a storage position and a floor cleaning position;
(c) a portable surface cleaning unit comprising a suction motor and an air treatment member removably mounted to the upper portion;
(d) an above floor cleaning wand removably mounted to the upper portion and comprising a lower end and an upper end;
(e) a flexible air flow conduit forming at least part of an air flow path from the above floor cleaning wand to the surface cleaning unit; and,
(f) a handle provided proximate the upper end of the wand and drivingly connected to the surface cleaning head when the wand is mounted to the upper portion, the handle comprising a bleed valve.

In some embodiments, the bleed valve is positionable in a plurality of different positions, wherein differing amounts of bleed air are admitted when the bleed valve is in the different positions.

In some embodiments, the surface cleaning apparatus further comprises a control member operable between a plurality of positions and the position of the bleed valve is adjusted by adjustment of the control member to a different operating position.

In some embodiments, the control member comprises a manually operable member.

In some embodiments, the control member is operatively connected to a brush drive motor that is provided in the surface cleaning head, the brush drive motor is operable in at least two operating modes comprising at least two of a high speed mode, a low speed mode and an off mode in which a brush driven by the brush motor does not rotate, and the control member is operable to adjust the mode of the brush drive motor wherein the position of the bleed valve is automatically adjusted when the control member adjusts the operating mode of the brush drive motor.

In some embodiments, the amount of bleed air that is admitted is selected based on the operating mode of the brush drive motor.

In some embodiments, the position of the bleed valve is pre-determined based on the position of the control member.

In some embodiments, the bleed valve is automatically adjusted to admit less bleed air as the brush drive motor is adjusted to operate at a lower speed.

In a second aspect there is provided a surface cleaning apparatus wherein the handle assembly is provided with a control member for adjusting (e.g., operable by the user) to position of a bleed valve. Different surfaces may require different flow rates at the air inlet of the surface cleaning head. Accordingly, a bleed valve may be provided so as to admit bleed air upstream of the air treatment member. If the air treatment member is a cyclone, then admitting bleed air through the handle will enable essentially the same flow rate of air to enter the cyclone while reducing the air flow at the surface cleaning head inlet Accordingly, the cyclonic flow pattern in the cyclone is not affected. Providing the control on the handle assembly enables a user to adjust the bleed air while continuing to clean.

In accordance with this aspect, there is provided an upright surface cleaning apparatus having comprising:

(a) a surface cleaning head having a dirty air inlet, a brush and a brush drive motor;

(b) a handle drivingly connected to the surface cleaning head;

(c) a bleed valve positioned proximate the handle; and, (d) a control member positioned proximate the handle and operable between a plurality of positions and the position of the bleed valve is adjusted by adjustment of the control member to a different operating position.

In some embodiments, the control member is operable by a user when the user is using the handle to direct the surface cleaning head.

In some embodiments, the control member comprises a manually operable member that is positionable in a plurality of positions and the bleed valve is adjusted to admit differing amounts of bleed air by adjustment of the control member to a different operating position.

In some embodiments, the control member is operatively connected to the brush drive motor, the brush drive motor is operable in at least two operating modes comprising at least two of a high speed mode, a low speed mode and an off mode in which a brush driven by the brush motor does not rotate, and the control member is operable to adjust the mode of the brush drive motor wherein the position of the bleed valve is automatically adjusted when the control member adjusts the operating mode of the brush drive motor, whereby the amount of bleed air that is admitted is selected based on the operating mode of the brush drive motor.

In some embodiments, the position of the bleed valve is pre-determined based on the position of the control member.

In some embodiments, the control member is operatively connected to the brush drive motor and the bleed valve is automatically adjusted to admit less bleed air as the brush drive motor is adjusted to operate at a lower speed.

In a third aspect there is provided a surface cleaning apparatus wherein the handle assembly that is an adjustable bleed valve and a brush that is operable at different speeds wherein the position of the bleed valve is selected based on the brush speed that is used. Different surfaces may require different flow rates at the air inlet of the surface cleaning head. Accordingly, a bleed valve may be provided so as to admit bleed air upstream of the air treatment member. If the air treatment member is a cyclone, then admitting bleed air through the handle will enable essentially the same flow rate of air to enter the cyclone while reducing the air flow at the surface cleaning head inlet Accordingly, the cyclonic flow pattern in the cyclone is not affected. In addition, different surfaces may require different brush speeds (e.g., the brush may be turned off for hard floors and on for carpet). An advantage of using a single control to adjust both enables both the brush speed and the amount of bleed valve to be simultaneously adjusted. If the control is manually adjustable, then a user may be able to adjust a control to the position recommended for a selected surface and the brush speed and the amount of bleed valve are automatically adjusted.

In accordance with this aspect, there is provided a surface cleaning apparatus having comprising:

(a) a surface cleaning head having a dirty air inlet, a brush and a brush drive motor, the brush drive motor is operable in at least two operating modes comprising at least two of a high speed mode, a low speed mode and an off mode in which a brush driven by the brush motor does not rotate;

(b) a handle assembly drivingly connected to the surface cleaning head;

(c) a body housing a bleed valve that is positionable in a plurality of different positions; and, (d) a control member operatively connected to the brush drive motor and operable to adjust the mode of the brush drive motor wherein the position of the bleed valve is automatically adjusted when the control member adjusts the operating mode of the brush drive motor.

In some embodiments, the position of the bleed valve is pre-determined based on the position of the control member.

In some embodiments, the control member is operatively connected to the brush drive motor and the bleed valve is automatically adjusted to admit less bleed air as the brush drive motor is adjusted to operate at a lower speed.

In some embodiments, the control member is operable by a user when the user is using the handle assembly to direct the surface cleaning head.

In some embodiments, the handle assembly comprises an above floor cleaning wand and removable with the wand for above floor cleaning.

In some embodiments, the bleed valve is part of a handle of the handle assembly.

It will be appreciated by a person skilled in the art that a surface cleaning apparatus may embody any one or more of the features contained herein and that the features may be used in any particular combination or sub-combination.

The drawings included herewith are for illustrating various examples of articles, methods, and apparatuses of the teaching of the present specification and are not intended to limit the scope of what is taught in any way.

DRAWINGS

Figure 1:
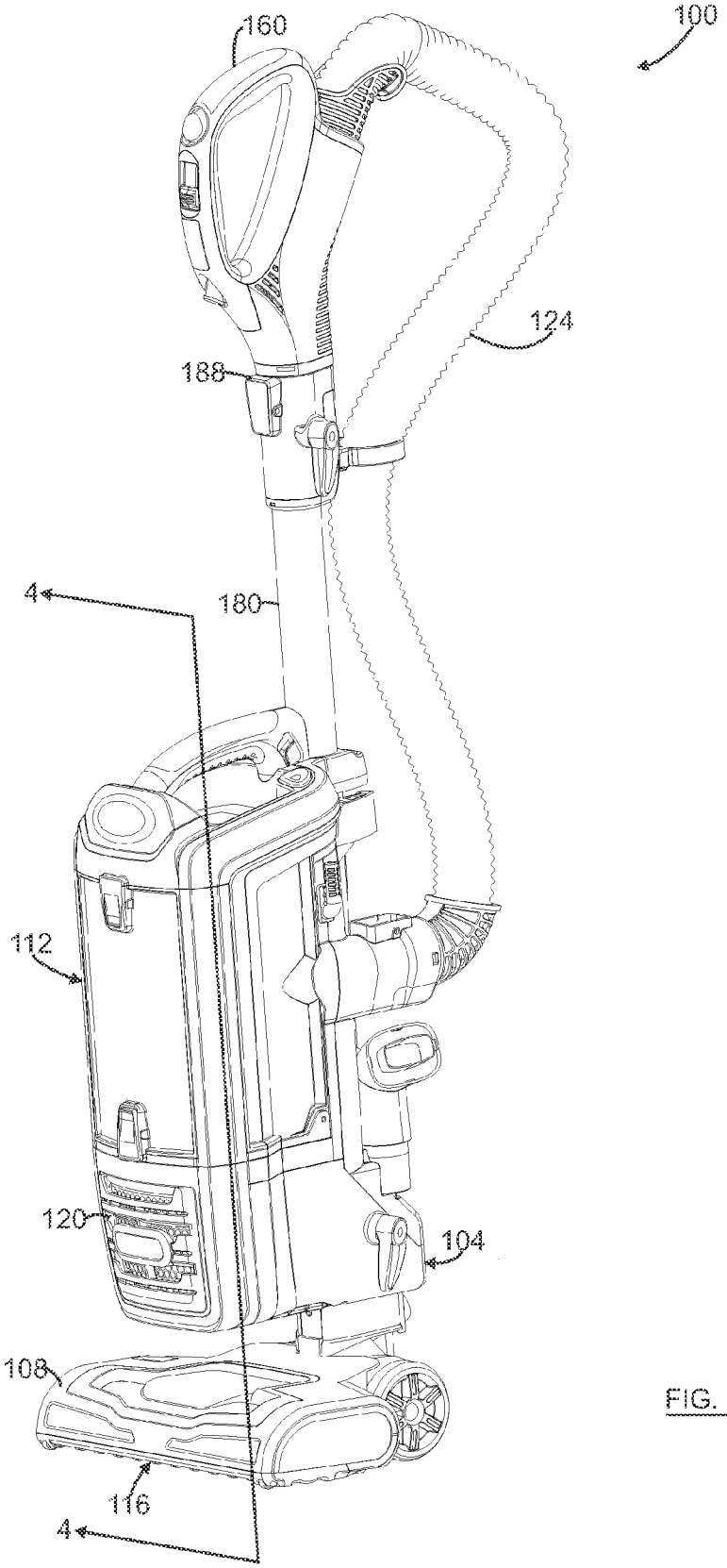
FIG. 1 is a front perspective view of a surface cleaning apparatus in a storage position.
Figure 3:
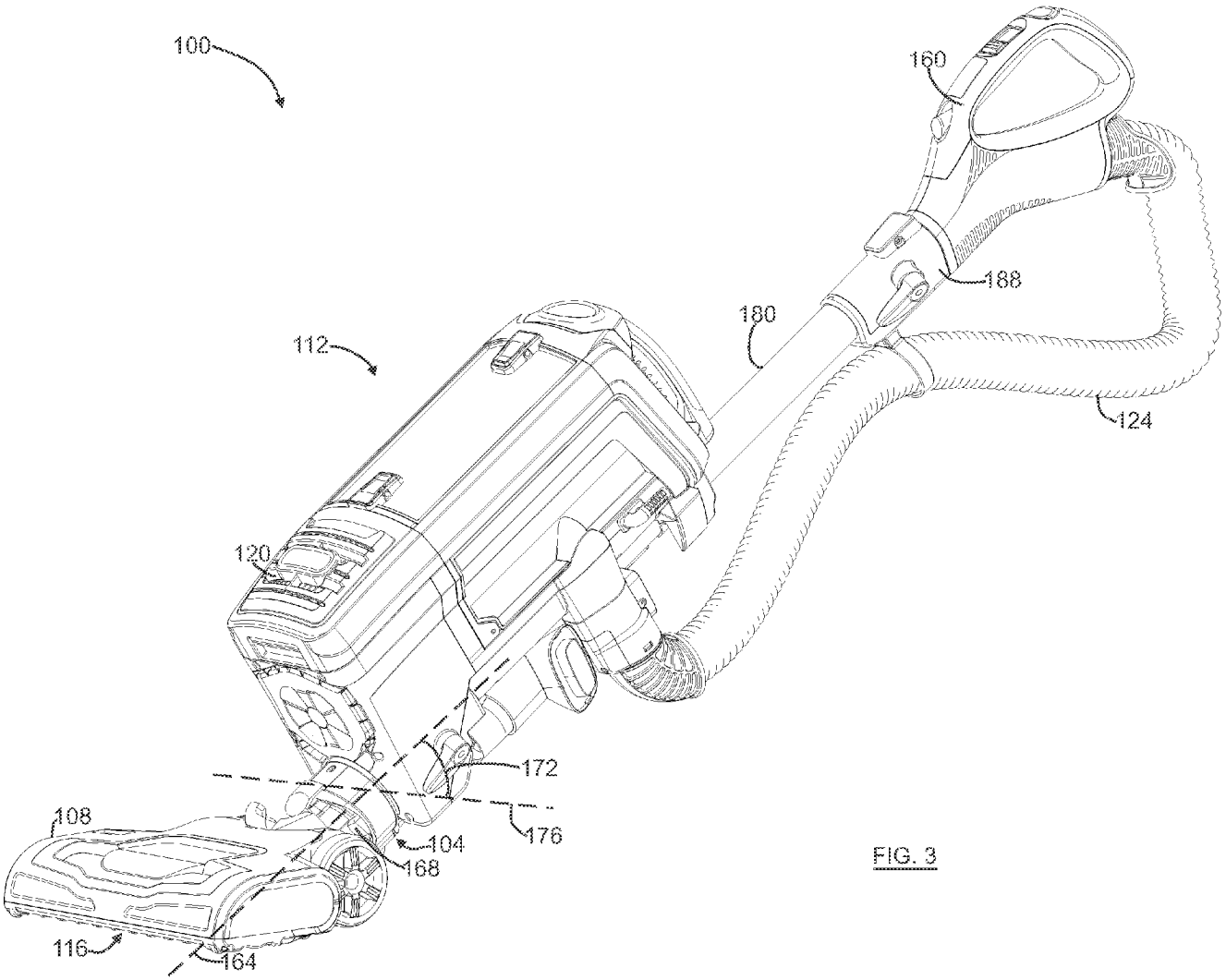
FIG. 3 is a front perspective view of the surface cleaning apparatus of FIG. 1, in a floor cleaning position.
Figure 3A:
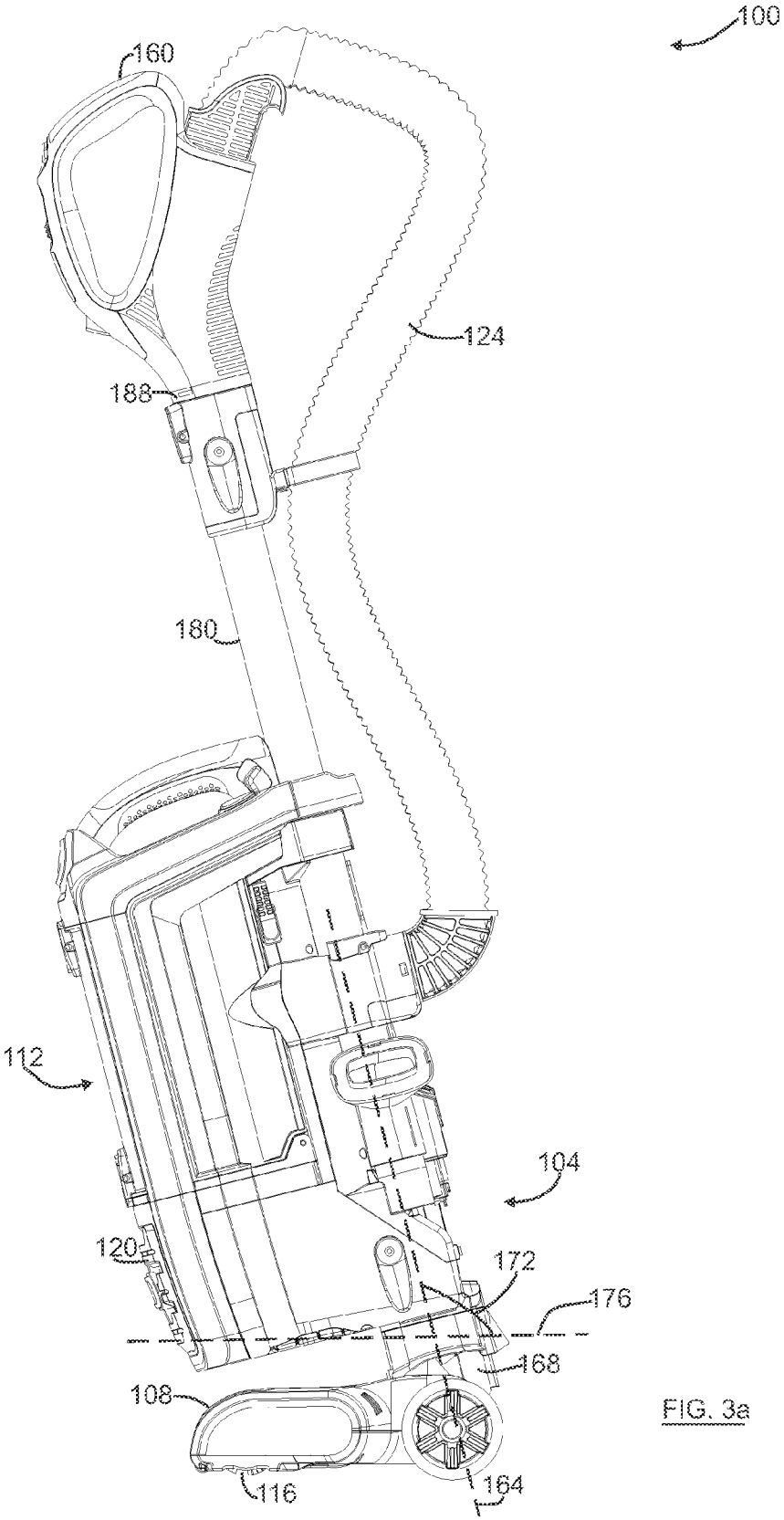
Figure 4:
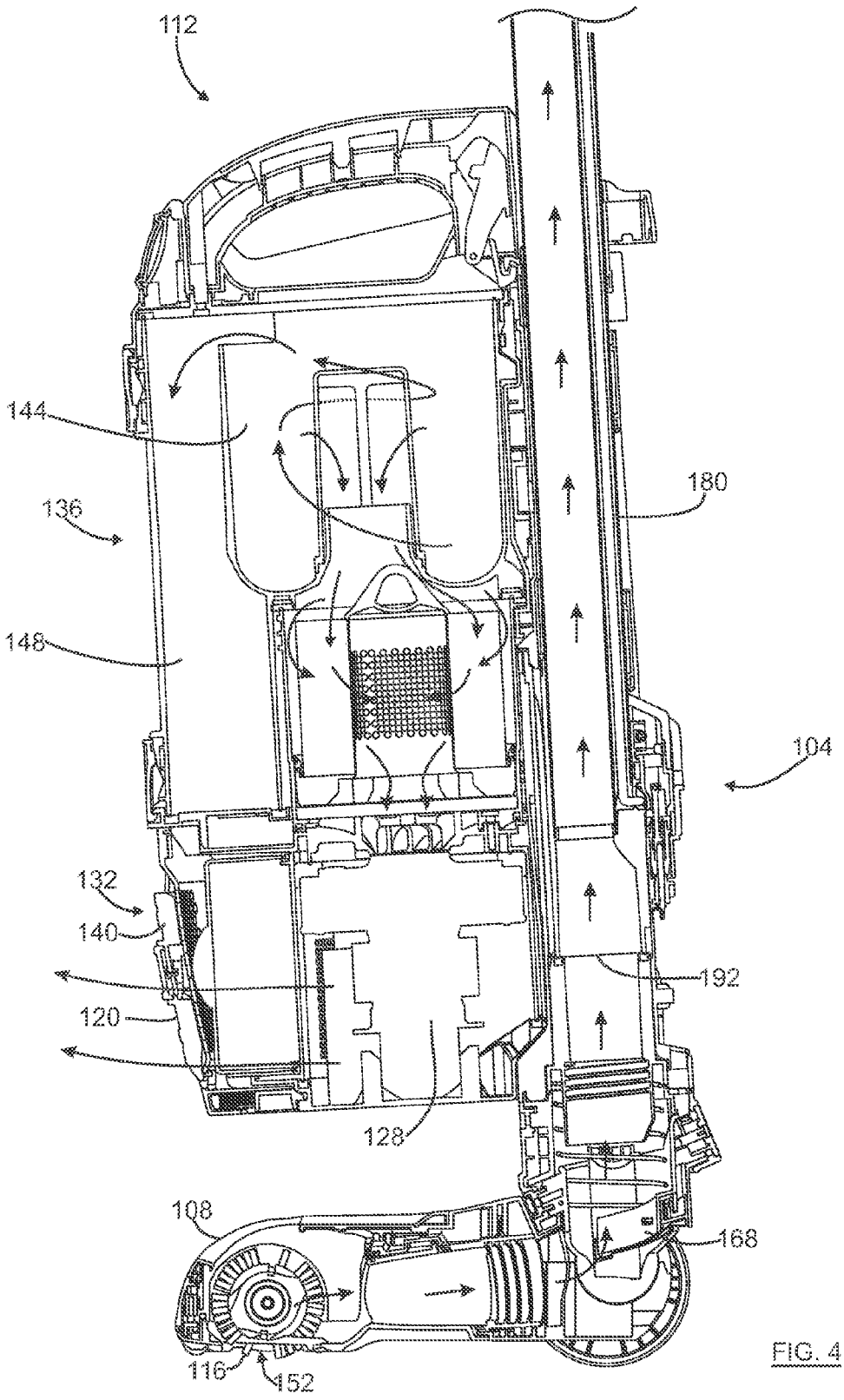
Figure 5:
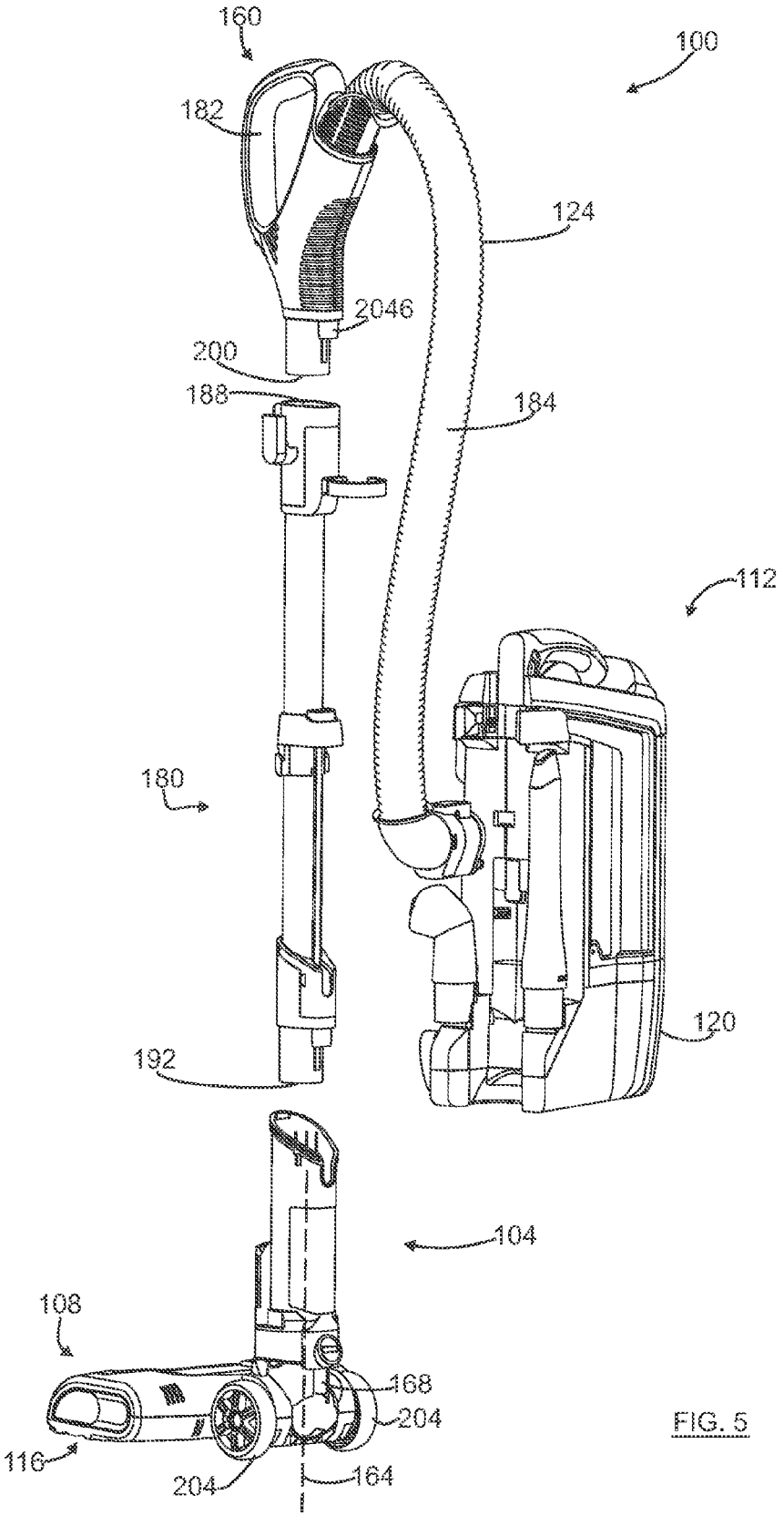
Figure 6:
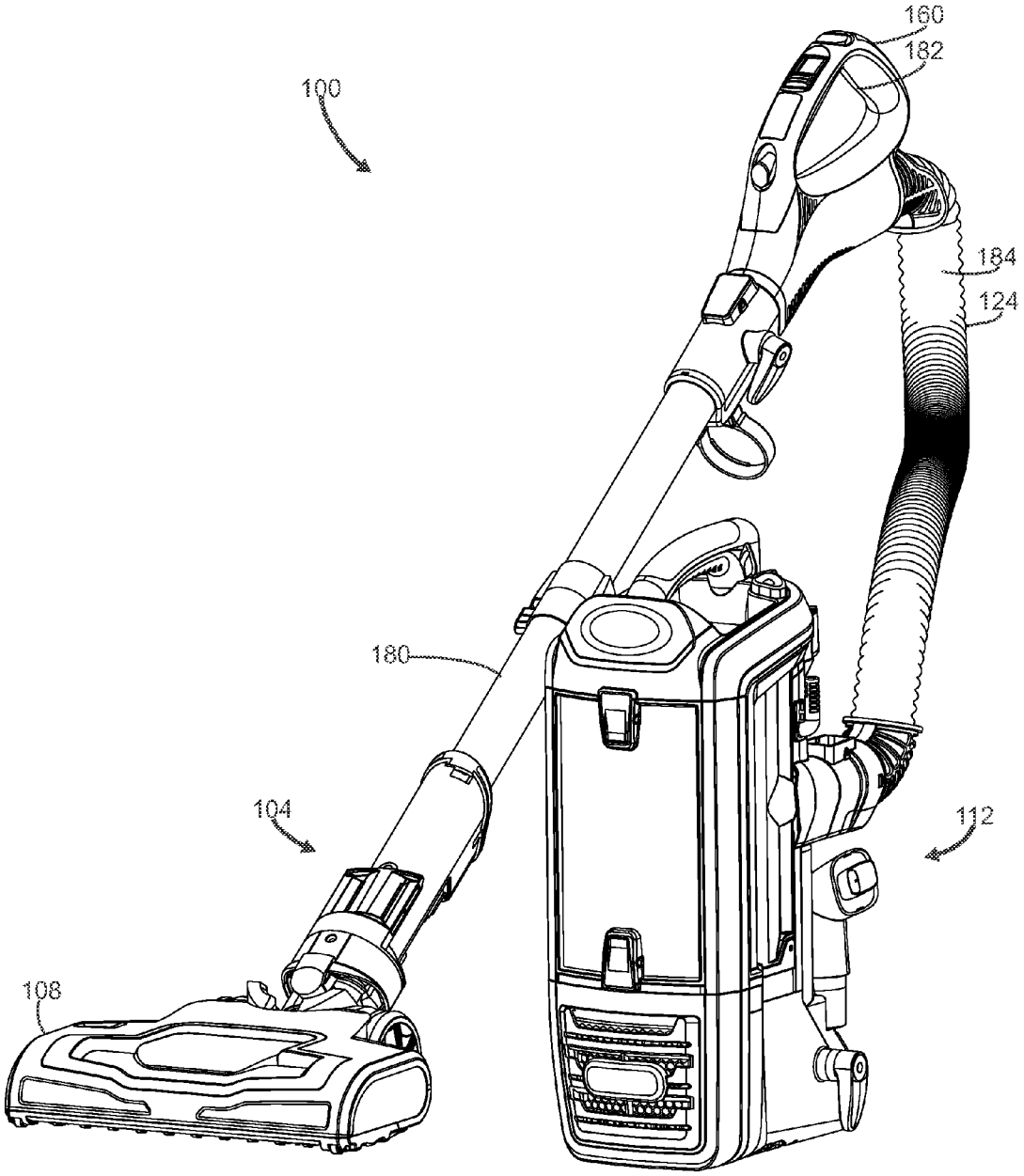
Figure 7:
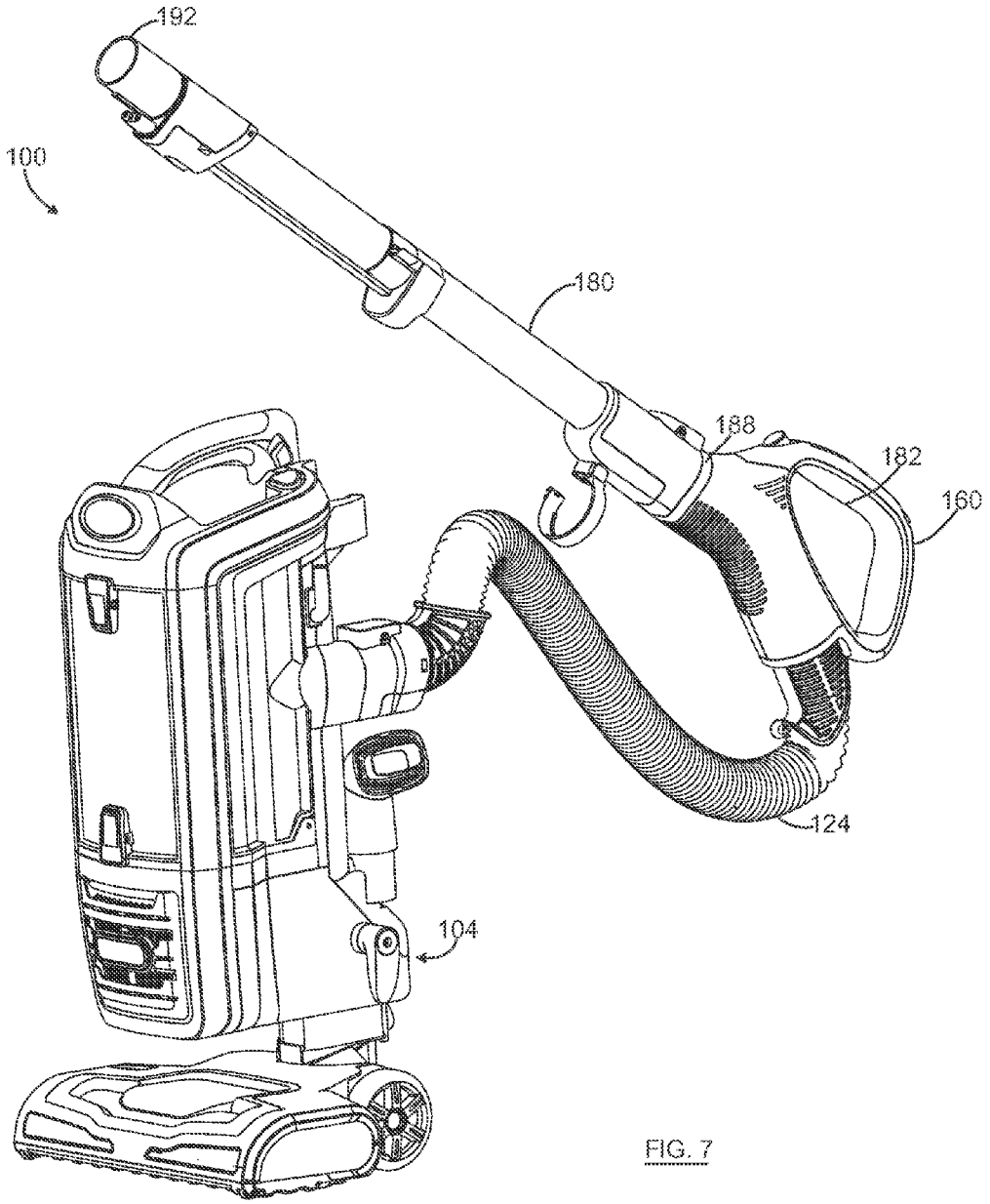
Figure 8:
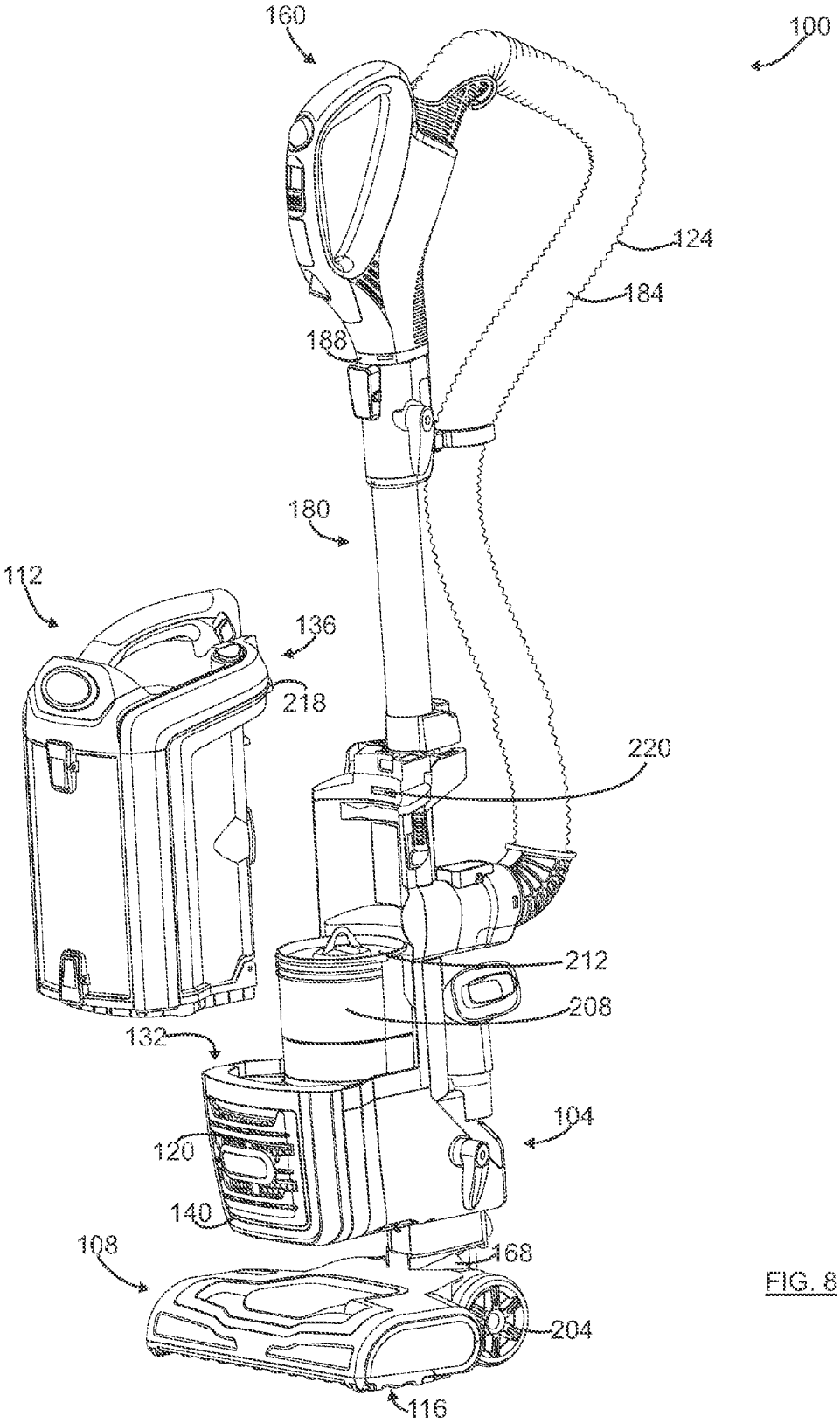
Figure 9:
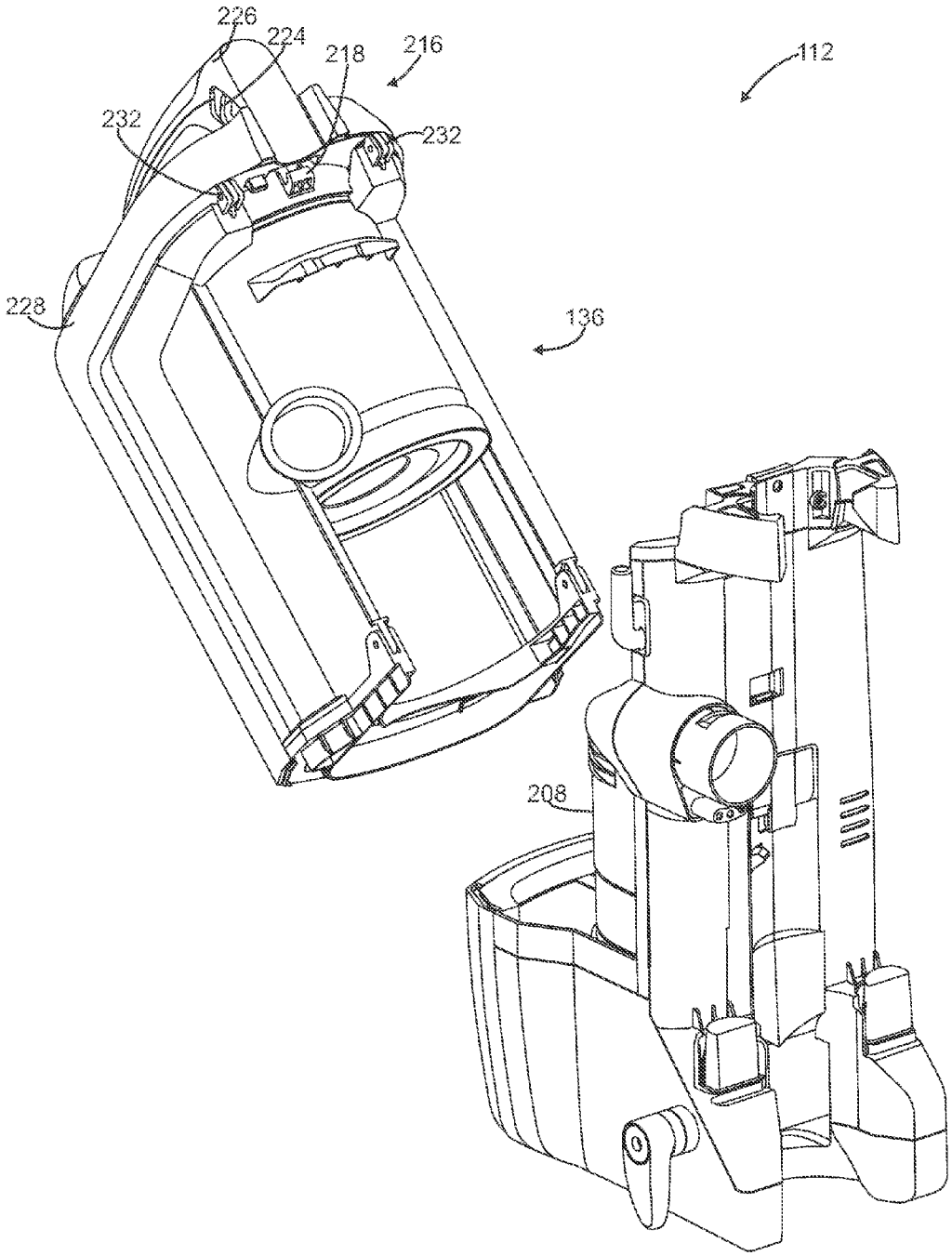
Figure 10:
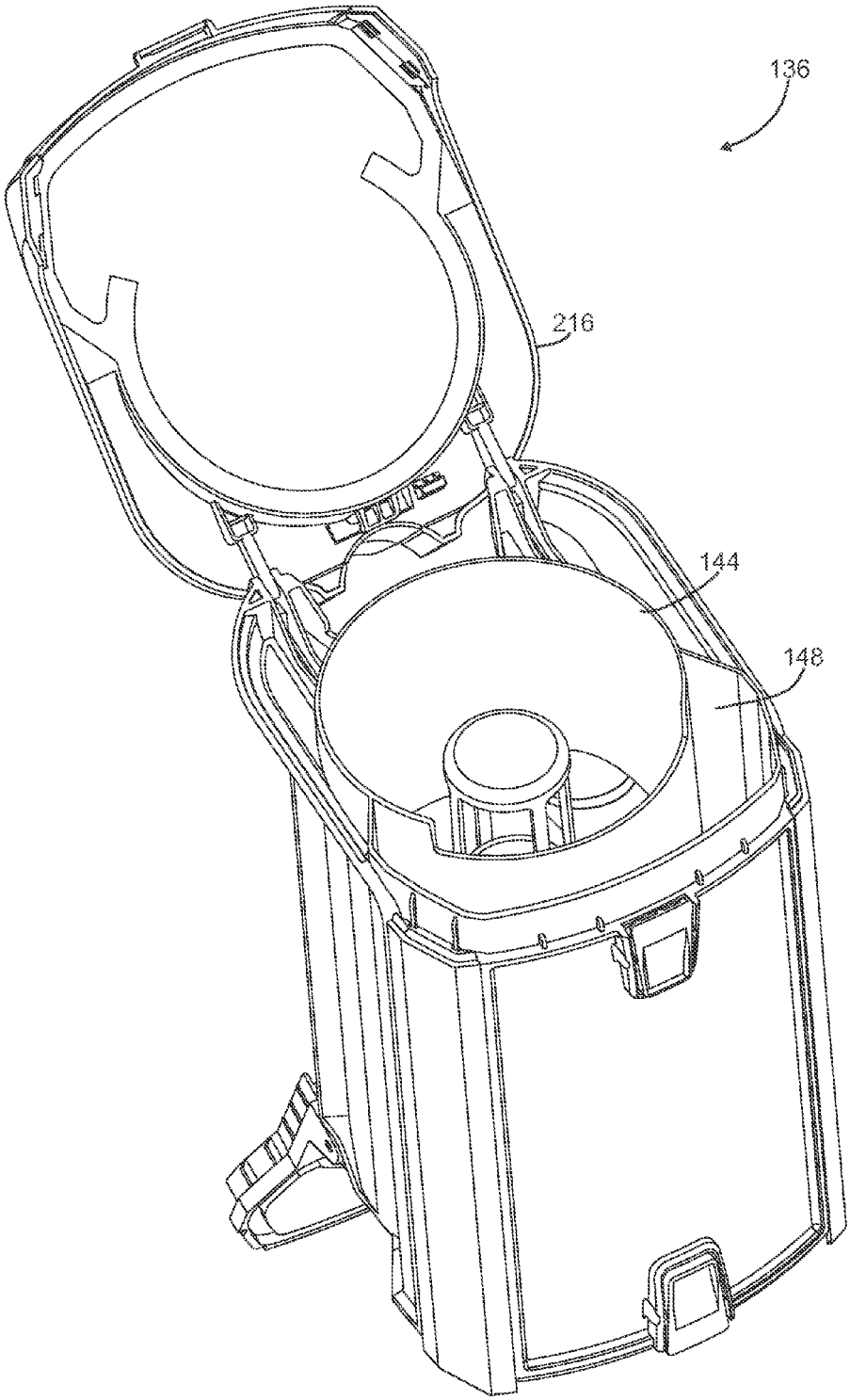
Figure 11:
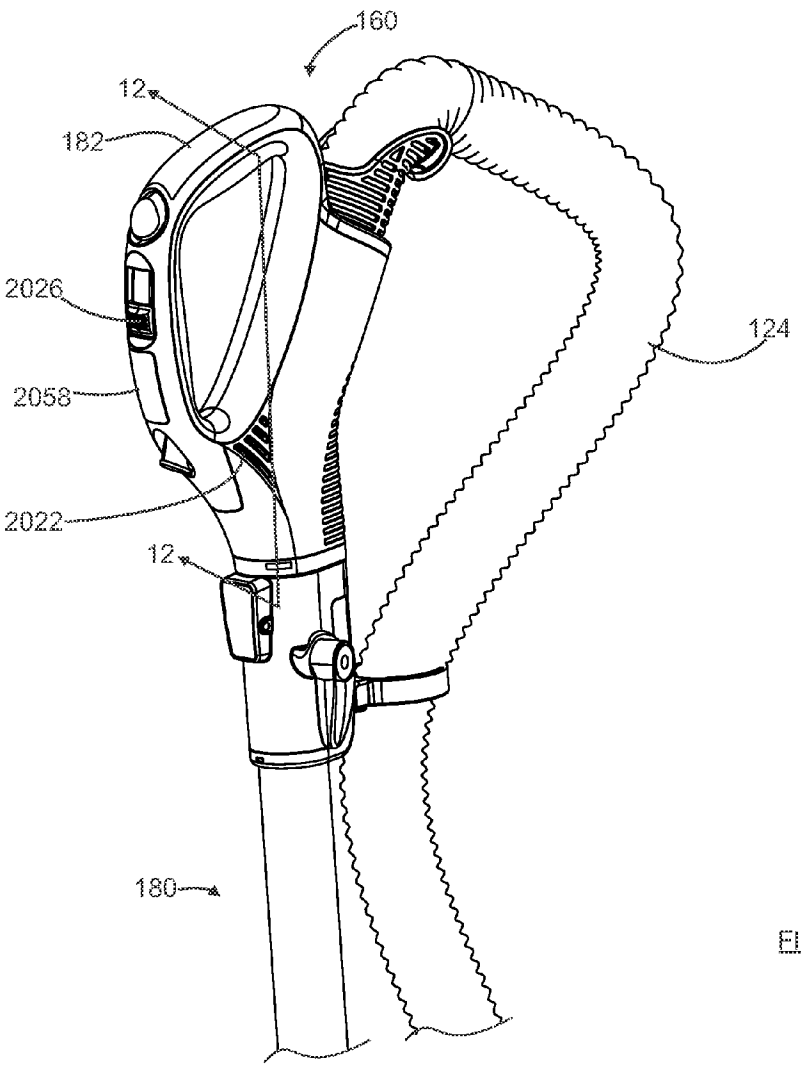
Figure 12B:
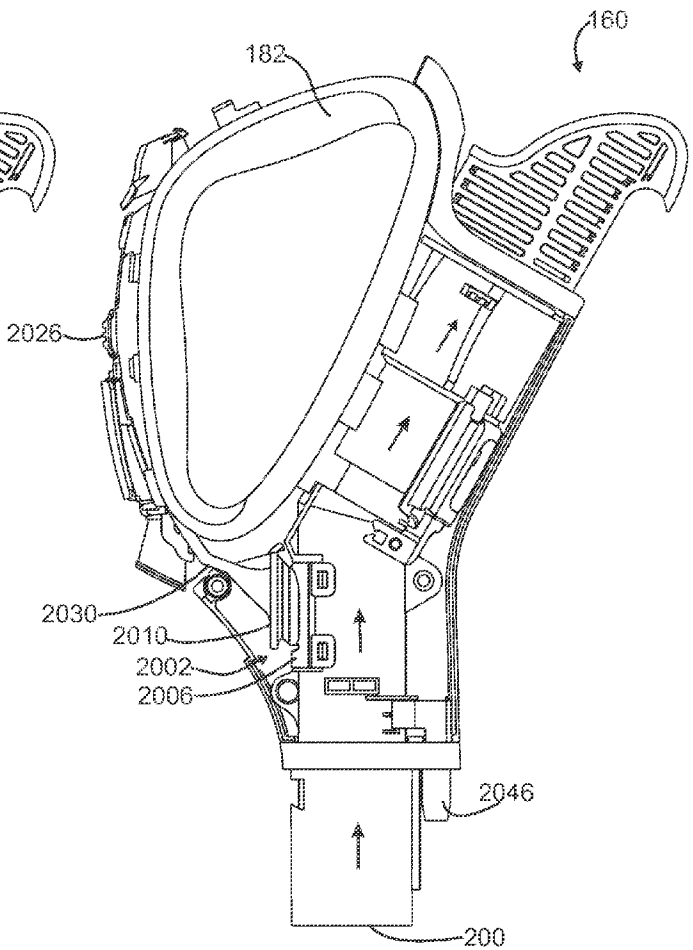
Figure 12A:
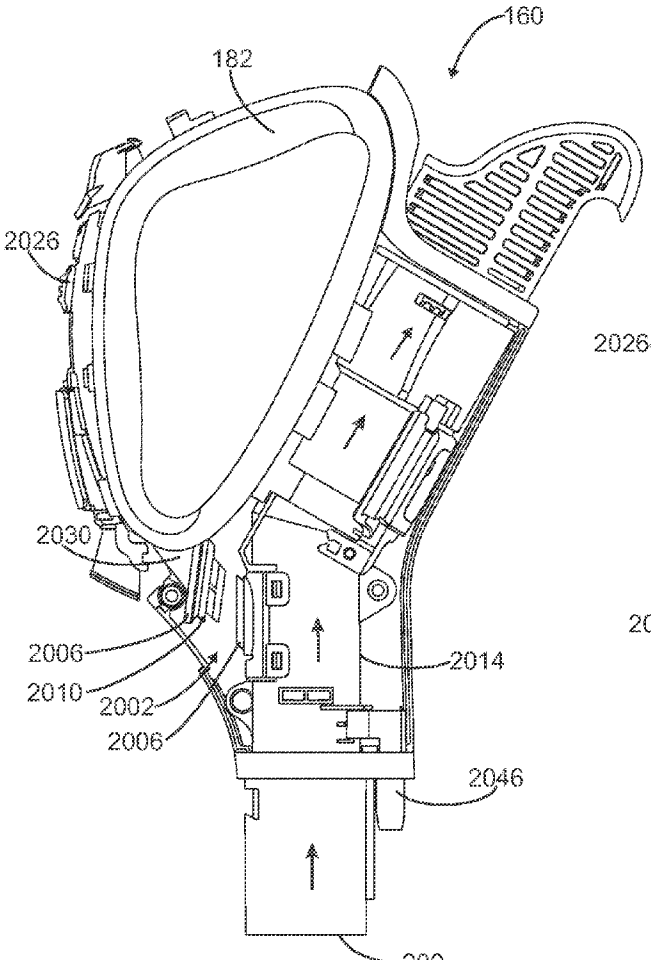
Figure 13:
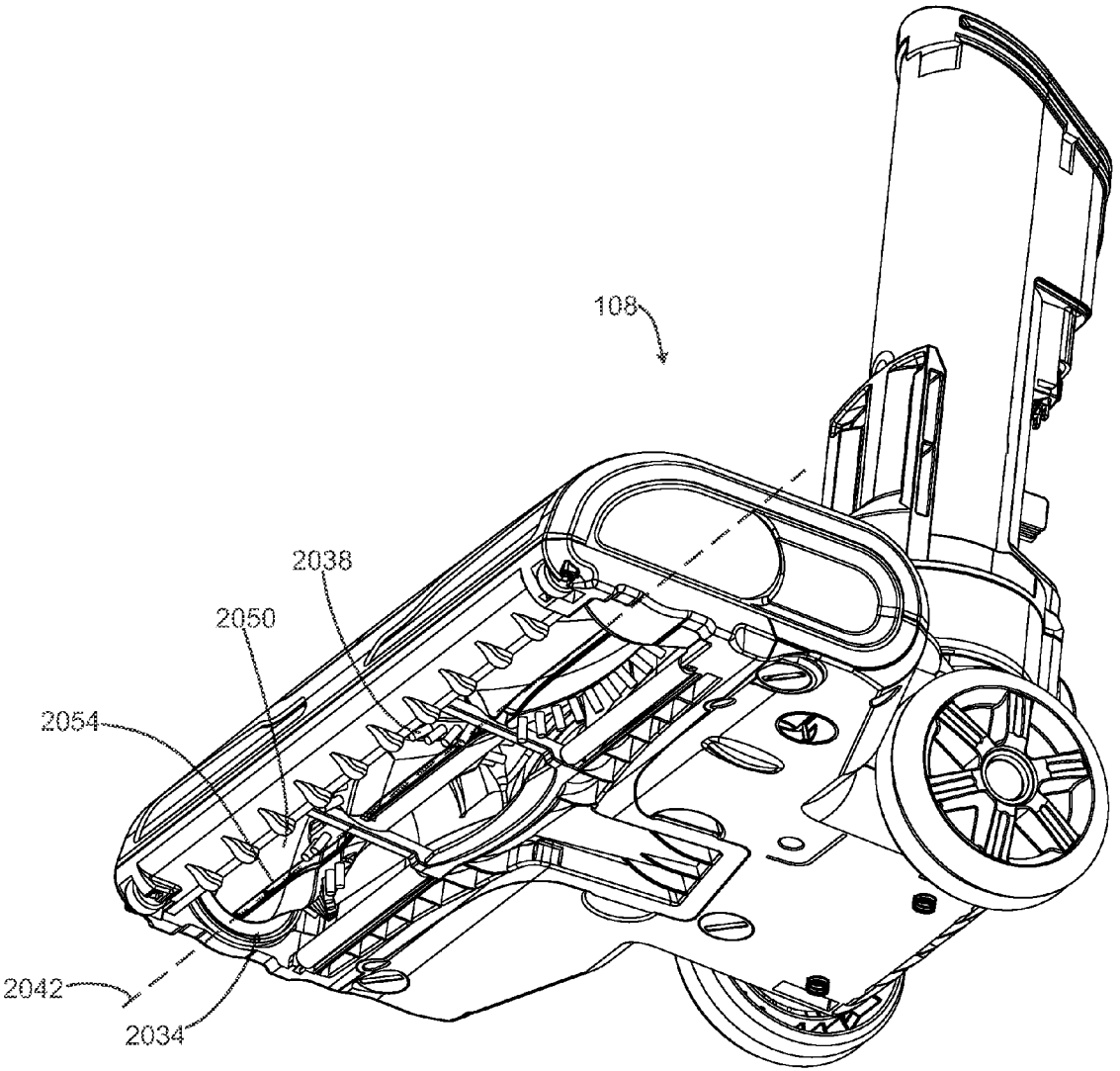
Figure 14A:
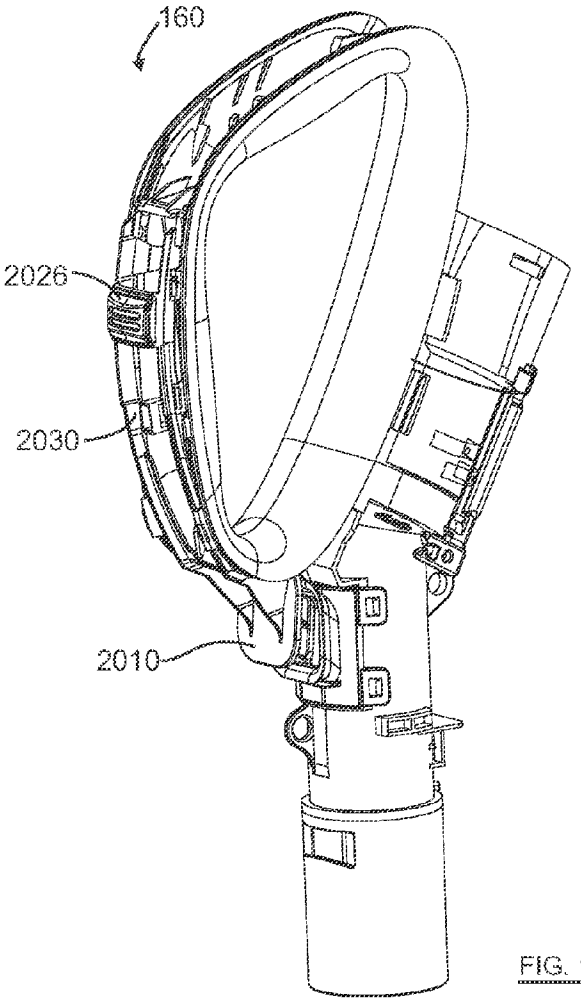
Figure 14B:
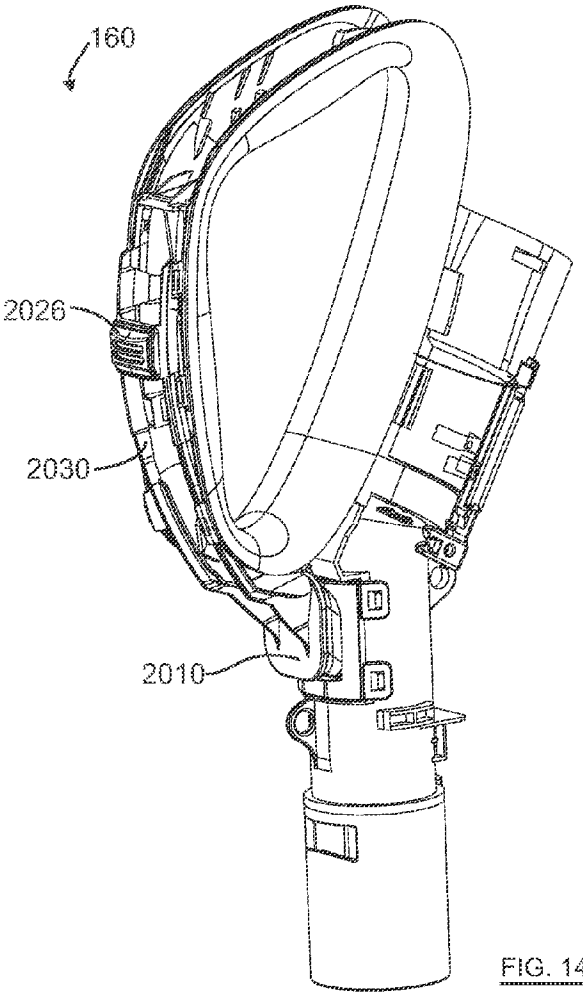

FIG. 3*a* is a side elevation view of the surface cleaning apparatus of FIG. 1, in a storage position;

FIG. 4 is a partial cross-sectional view taken along line 4-4 in FIG. 1;

FIG. 5 is a rear perspective view of the surface cleaning apparatus of FIG. 1, in a partially disassembled configuration;

FIG. 6 is a front perspective view of the surface cleaning apparatus of FIG. 1, with the pod removed but still in air flow communication with the surface cleaning head;

FIG. 7 is a front perspective view of the surface cleaning apparatus of FIG. 1, in an above-floor cleaning configuration;

FIG. 8 is a front perspective view of the surface cleaning apparatus of FIG. 1 wherein the cyclone bin assembly has been removed;

FIG. 9 is a rear perspective view of the portable surface cleaning unit with the cyclone bin assembly removed;

FIG. 10 is a front perspective view of a cyclone bin assembly with the lid in an open position;

FIG. 11 is an enlarged partial front perspective view of the handle of FIG. 1 connected to the hose and the wand;

FIG. 12*a* is a cross sectional view taken along line 12-12 in FIG. 11 showing the bleed valve in an open position;

FIG. 12*b* is a cross sectional view taken along line 12-12 in FIG. 11 showing the bleed valve in the closed position;

FIG. 13 is a bottom perspective view of the surface cleaning head and the upper portion of FIG. 1;

FIG. 14*a* is a partial cut away front perspective view of the handle of FIG. 11 showing the bleed valve in an open position; and, FIG. 14*b* is a partial cut away front perspective view of the handle of FIG. 11 showing the bleed valve in the closed position.

DESCRIPTION OF VARIOUS EMBODIMENTS

Various apparatuses or processes will be described below to provide an example of an embodiment of each claimed invention. No embodiment described below limits any claimed invention and any claimed invention may cover processes or apparatuses that differ from those described below. The claimed inventions are not limited to apparatuses or processes having all of the features of any one apparatus or process described below or to features common to multiple or all of the apparatuses described below. It is possible that an apparatus or process described below is not an embodiment of any claimed invention. Any invention disclosed in an apparatus or process described below that is not claimed in this document may be the subject matter of another protective instrument, for example, a continuing patent application, and the applicants, inventors or owners do not intend to abandon, disclaim or dedicate to the public any such invention by its disclosure in this document.

General Description of an Upright Vacuum Cleaner

Figure 2:
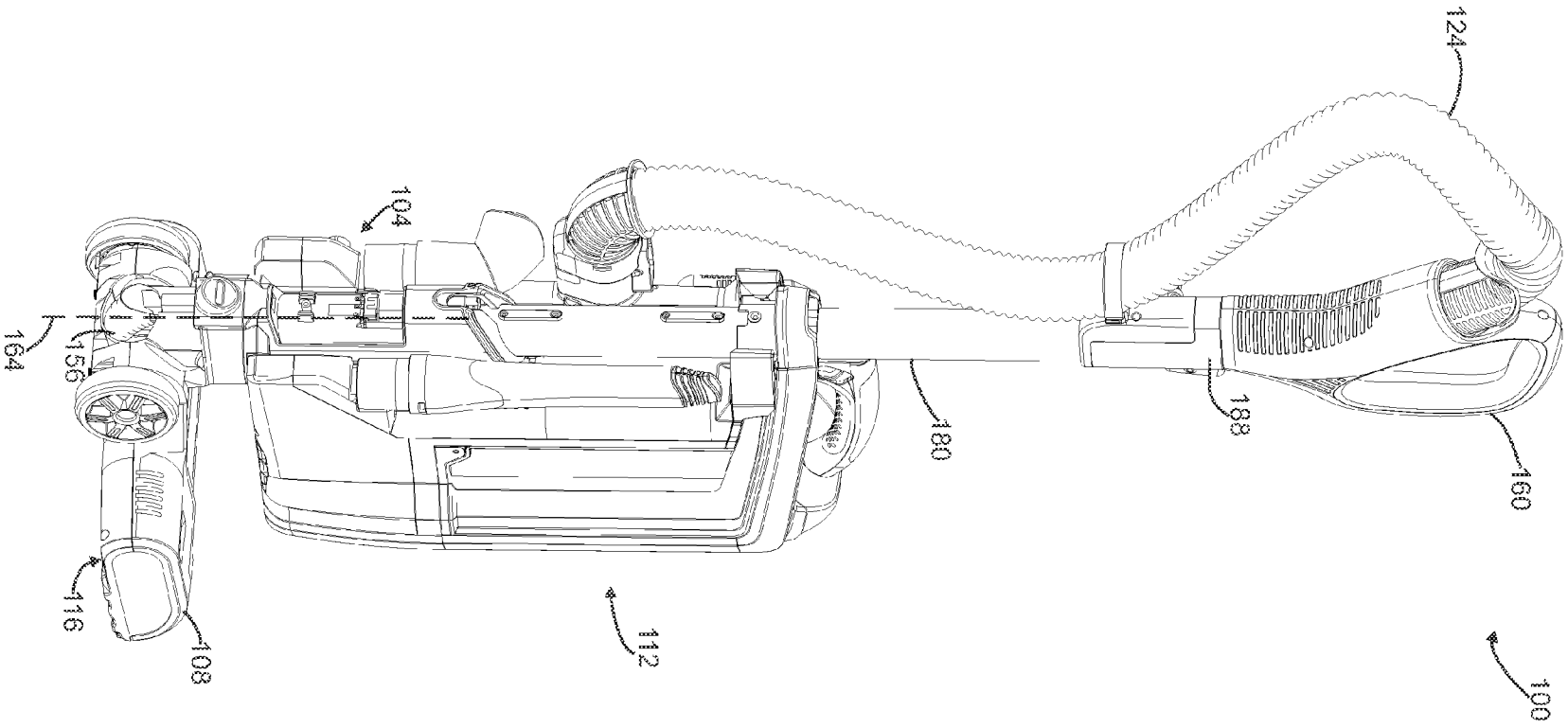
FIG. 2 is a rear perspective view of the surface cleaning apparatus of FIG. 1, in the storage position.

Referring to FIGS. 1-3, a first embodiment of a surface cleaning apparatus 100 is shown. In the embodiment shown, the surface cleaning apparatus 100 is an upright vacuum cleaner. In alternate embodiments, the surface cleaning apparatus may be another suitable type of surface cleaning apparatus, such as a canister type vacuum cleaner, and hand vacuum cleaner, a stick vac, a wet-dry type vacuum cleaner or a carpet extractor.

In the illustrated example, the surface cleaning apparatus 100 includes an upper portion or support structure 104 that is movably and drivingly connected to a surface cleaning head 108. A surface cleaning unit 112 is mounted on the upper portion 104. The surface cleaning apparatus 100 also has at least one dirty air inlet 116, at least one clean air outlet 120, and an air flow path or passage extending therebetween. In the illustrated example, the air flow path includes at least one flexible air flow conduit member (such as a hose 124 or other flexible conduit). Alternatively, the air flow path may be formed from rigid members.

At least one suction motor and at least one air treatment member are positioned in the air flow path to separate dirt and other debris from the airflow. The suction motor and the air treatment member may be provided in the upper portion and/or the surface cleaning head of an upright surface cleaning apparatus. Preferably, the suction motor and the air treatment member are provided in a removable surface cleaning unit. The air treatment member may be any suitable air treatment member, including, for example, one or more cyclones, filters, and bags, and preferably the at least one air treatment member is provided upstream from the suction motor. Preferably, as exemplified in FIG. 4, the portable surface cleaning unit 112 includes both the suction motor 128, which may be in a motor housing 132, and an air treatment member, which may be in the form of a cyclone bin assembly 136. Accordingly, surface cleaning unit 112 may be a hand vacuum cleaner, a pod or the like. The motor housing 132 can include at least one removable or openable door 140 which may allow a user to access the interior of the motor housing 132, for example to access the motor 128, a filter or any other component within the housing 132. The cyclone bin assembly 136 includes a cyclone chamber 144 and a dirt collection chamber 148.

In the embodiment shown, the surface cleaning head 108 includes the dirty air inlet 116 in the form of a slot or opening 152 (FIG. 4) formed in a generally downward facing surface of the surface cleaning head 108. From the dirty air inlet 116, the air flow path extends through the surface cleaning head 108, and through an up flow conduit 156 (FIG. 2) in the upper portion 104 to the surface cleaning unit 112. In the illustrated example, the clean air outlet 120 is provided in the front of the surface cleaning unit 112, and is configured to direct the clear air in a generally lateral direction, toward the front of the apparatus 100.

A handle or handle assembly 160 is drivingly connected to the upper portion 104 to allow a user to manipulate the surface cleaning apparatus 100. Referring to FIGS. 2, 3, and 3*a*, the upper portion extends along an upper axis 164 and is moveably mounted to the surface cleaning head 108. In the illustrated example, the upper portion 104 is pivotally mounted to the surface cleaning head via a pivot joint 168. The pivot joint 168 may be any suitable pivot joint. In this embodiment, the upper portion 104 is movable, relative to the surface cleaning head 108, between a storage position (FIG. 1), and a use or floor cleaning position (FIG. 3). In the floor cleaning position, the upper portion 104 may be inclined relative to the surface being cleaned, and an angle 172 between a plane 176 parallel to the surface and the upper axis 164 may be between about 20° and about 85°. In the storage position (FIG. 3*a*), the upper portion 104 may be inclined relative to the surface being cleaned, and the angle 172 between the plane 176 parallel to the surface and the upper axis 164 may be between about 85° and 135°.

Alternatively, or in addition to being pivotally coupled to the surface cleaning head 108, the upper portion 104 may also be rotatably mounted to surface cleaning head 108. In this configuration, the upper portion 104, and the surface cleaning unit 112 supported thereon, may be rotatable about the upper axis 164. In this configuration, rotation of the upper portion 104 about the upper axis 164 may help steer the surface cleaning head 108 across the floor (or other surface being cleaned). Alternately, the upper portion 104 may be pivotally mounted to the surface cleaning head about a second pivot axis, or otherwise moveable mounted with respect to the surface cleaning head, to provide steering.

It will be appreciated that the forgoing discussion is exemplary and that an upright vacuum cleaner may use a surface cleaning head, the surface cleaning unit and upper portion of any design and they may be moveably connected together by any means known in the art.

Cleaning Modes

The following is a description of the components of the surface cleaning apparatus that are configured to be disconnectable that may be used by itself in any surface cleaning apparatus or in any combination or sub-combination with any other feature or features disclosed herein.

Accordingly, in one aspect, the upright vacuum cleaner 100 may be operable in a variety of different functional configurations or operating modes. The versatility of operating in different operating modes may be achieved by permitting the surface cleaning unit 112 to be detachable, e.g., from the upper portion 104. Alternatively, or in addition, further versatility may be achieved by permitting portions of the vacuum cleaner (e.g., one or more of a surface cleaning head, an above floor cleaning wand, a handle assembly, a hose) to be detachable from each other at a plurality of locations, and re-connectable to each other in a variety of combinations and configurations.

In the examples illustrated, mounting the surface cleaning unit 112 on the upper portion 104 increases the weight of the upper portion 104 and can affect the maneuverability and ease of use of the surface cleaning apparatus 100. With the surface cleaning unit 112 attached, the vacuum cleaner 100 may be operated like a traditional upright style vacuum cleaner, as illustrated in FIGS. 1-3.

Alternatively, in some cleaning situations the user may preferably detach the surface cleaning unit 112 from the upper portion 104 and choose to carry the surface cleaning unit 112 (e.g. by hand or by a strap) separately from the upper portion 104, while still using the upper portion 104 to drivingly maneuver the surface cleaning head 108. When the surface cleaning unit 112 is detached, a user may more easily maneuver the surface cleaning head 108 around or under obstacles, like furniture and stairs.

To enable the vacuum suction generated by the surface cleaning unit 112 to remain in airflow communication with the surface cleaning head 108 when the surface cleaning unit 112 is detached from the support structure 104, the airflow connection between the surface cleaning head 108 and the cleaning unit 112 is preferably at least partially formed by a flexible conduit, such as flexible hose 124, which may be an electrified hose. Preferably, the hose 124 is extensible and more preferably is elastically or resiliently extensible. The use of a flexible conduit allows a user to detach the surface cleaning unit 112 and maintain a flow connection between the portable surface cleaning unit 112 and the surface cleaning head 108 without having to reconfigure or reconnect any portions of the airflow conduit 184 (FIG. 6).

In the example shown, the airflow path between the surface cleaning head 108 and the cleaning unit 112 further includes an above floor cleaning wand 180. Wand 180 may be positioned upstream of hose 124 and downstream of surface cleaning head 108. Preferably, wand 180 may be drivingly connected to upper portion 104 so that wand 108 may be used to direct surface cleaning head 108 (e.g., forwardly and rearwardly) and, optionally, for also steering surface cleaning head 108. Accordingly, wand 180 comprises a rigid airflow conduit having any suitable shape. For example, wand 180 may be straight as shown or it may be curved or bent. In some embodiments, wand 180 may be reconfigurable. For example, wand 108 may have upper and lower sections that are moveably mounted with respect to each other (e.g., pivotally connected) so that wand 180 may be converted from a straight configuration to a bent configuration. Further, wand 180 may have any suitable cross-sectional shape, such as a circular cross-section as shown, or another cross-sectional shape such as square, triangular, or another regular or irregular shape.

Wand 180 may be telescopic so that it is extendable.

In order to enable a user to use wand 180 to remotely maneuver surface cleaning head 108, wand 180 may be provided with a handle assembly. Preferably, handle assembly or handle 160 is positioned proximate an upper (i.e. downstream) end 188 of wand 180. For example, handle 160 may be connected to one or both of wand 180 and hose 124. Optionally, handle 160 may form part of the airflow path between wand 180 and hose 124. Alternatively, handle 160 may be peripherally attached to one or both of wand 180 and hose 124 without participating in the airflow communication between wand 180 and hose 124.

A user may grasp a hand grip portion 182 of handle 160 to manipulate wand 180 (e.g. for moving upper portion 104 and steering surface cleaning head 108). In alternative embodiments, surface cleaning apparatus 100 may not include a handle 160 and instead a user may grasp wand 180 directly.

Reference is now made to FIG. 5. As shown, upper portion 104 is moveably mounted with respect to surface cleaning head 108. Upper portion 104 may be connected to surface cleaning head 108 by any means known in the art, (e.g., it may be pivotally mounted, rotationally mounted or the like). As exemplified, pivot joint 168 permits upper portion 104 to tilt and/or pivot with respect to surface cleaning head 108.

One or both of wand 180 and surface cleaning unit 112 may be selectively attached or detached from upper portion 104. As exemplified, each of wand 180 and surface cleaning unit 112 is selectively attachable or detachable from upper portion 104. An advantage of this design is that a user may convert the vacuum cleaner to a surface cleaning mode by removing the wand without having to remove surface cleaning unit 112. Preferably, each of wand 180 and surface cleaning unit 112 may be selectively connected or disconnected from upper portion 104 independently of the other. For example, wand 180 and surface cleaning unit 112 may be connected or disconnected from upper portion 104 in any order, sequentially or simultaneously. This may simplify the reconfiguration of surface cleaning apparatus 100 into different cleaning modes without requiring disruption to the operation of surface cleaning apparatus 100. Accordingly, an actuator 1058 may be provided for releasing a surface cleaning unit lock and, further, the actuator and locking mechanism (e.g., the moveable components and the detent that is receivable in upper portion 104) may be provided on the surface cleaning unit and removable therewith (see for example FIG. 6). Similarly an actuator 1058 may be provided for releasing a wand lock and, further, the actuator and locking mechanism (e.g., the moveable components and the detent that is receivable in upper portion 104) may be provided on the wand and removable therewith (see for example FIG. 5)

As exemplified, when upstream end 192 of wand 180 is connected to upper portion 104, the surface cleaning head 108 participates in the airflow path in a floor cleaning mode, e.g., for cleaning floors, stairs, and the like. In such a case, the surface cleaning unit 112 may be mounted on upper portion 104, for supporting the weight of surface cleaning unit on upper portion 104 (e.g., as shown in FIG. 3 which exemplifies a traditional floor cleaning mode for an upright vacuum cleaner). Alternately, surface cleaning unit 112 may be dismounted from upper portion 104 and carried by hand, worn as a backpack, or placed on the floor for example while wand 180 is connected to surface cleaning head 108 (e.g., as shown in FIG. 6 which exemplifies an alternate floor cleaning mode for an upright vacuum cleaner).

As exemplified, wand 180 may be disconnected from upper portion 104 for use in an above-floor cleaning mode. In one embodiment, surface cleaning unit 112 may be mounted on upper portion 104, for supporting the weight of surface cleaning unit on upper portion 104 while wand 180 is used in the above floor cleaning mode (e.g., as shown in FIG. 7). Alternately, in another optional embodiment, surface cleaning unit 112 may also be dismounted from upper portion 104 and carried by hand, worn as a backpack, or placed on the floor for example while wand 180 is used in the above floor cleaning mode.

Wand 180 may be selectively connected or disconnected from the airflow path, such as when the extension in reach it provides is not required. For example, downstream end 188 of wand 180 may be separated from handle 160. The reduced reach provided by this configuration may be advantageous where the user may wish to manipulate the cleaning surface by hand (e.g. separate cushions in a couch) while cleaning, or where the user may require fine control (e.g. to avoid sucking up objects on the cleaning surface).

If Wand 180 and surface cleaning unit 112 are each individually removable, then they may each be independently mounted to upper portion 104. Wand 180 and surface cleaning unit 112 may connect to upper portion 104 in any suitable fashion. In the example shown, wand 180 is inserted into upper portion 104, and surface cleaning unit 112 is mounted to an exterior of upper portion 104. In such a case, upper portion 104 may provide part or all of the air flow path from surface cleaning head 108 to wand 180. In other embodiments, upper portion 104 need not be part of the air flow path. For example, wand 180 may be mounted to the exterior of upper portion 104 and the inlet end may seat on an outlet end of a duct provided on the outer surface of the upper portion 104.

Referring to FIG. 6, when the surface cleaning apparatus 100 is in use, a user may detach the surface cleaning unit 112 from the upper portion 104 without interrupting the airflow communication between the cleaning unit 112 and the surface cleaning head 108. This allows a user to selectively detach and re-attach the cleaning unit 112 to the support structure 104 during use without having to stop and reconfigure the connecting hose 124 or other portions of the airflow conduit 184. As exemplified, wand 180 is attached to upper portion 104 and surface cleaning unit 112 is detached from upper portion 104.

FIG. 6 illustrates a configuration in which the vacuum cleaner 100 can be operated with the surface cleaning unit 112 detached from the upper portion 104 and the air flow path between the surface cleaning unit 112 and the surface cleaning head 108 remains intact. In this configuration, upper portion 104 may provide a connection between wand 180 and surface cleaning head 108, which may permit surface cleaning head 108 to be driven by manipulating wand 180.

In addition to being operable to clean floors or surfaces, the vacuum cleaner may be operated in a variety of cleaning modes that do not include use of the surface cleaning head, and may be generally described as above floor cleaning modes. This can generally include cleaning furniture, walls, drapes and other objects as opposed to cleaning a large, planar surface.

In one example of an above floor cleaning mode, as exemplified in FIG. 7, the surface cleaning unit 112 can remain mounted on the upper portion 104. This eliminates the need for the user to separately support the weight of the surface cleaning unit 112 in an above floor cleaning mode. In the illustrated configuration, the surface cleaning unit 112 may remain mounted on the upper portion 104 and the wand 180 may be detached from upper portion 104 to provide an extended reach for above floor cleaning. Optionally, additional accessory tools may be coupled to the upstream end 192 of wand 180, including for example a crevice tool, a cleaning brush (optionally an electrically powered brush or an air driven turbo brush) and any other type of accessory including a power tool such as a sander.

Further, as illustrated in FIG. 5, the upstream end 200 of the handle 160 may be separated from the downstream end 188 of wand 180. In this configuration the upstream end 200 of the handle 160 can function as the dirty air inlet for the vacuum cleaner 100. Optionally, accessory tools, such as wands, crevasse tools, turbo brushes, hoses or other devices may be coupled to the upstream end 200 of the handle 160.

In another example of an above floor cleaning mode, as exemplified in FIG. 5, the surface cleaning unit 112 and wand 180 can both be detached from the upper portion 104. The upstream end 200 of handle 160 may be selectively connected or disconnected from downstream end 188 of wand 180 as desired. This configuration may be advantageous when surface cleaning unit 112 must be held above the floor (e.g. while the user is standing on a ladder). In this case, the upper portion 104 and surface cleaning head 108 may add unnecessary weight to the surface cleaning unit 112. This configuration may also be advantageous when the surface cleaning unit 112 is to be rested on a sloped surface. In this case, the rear wheels 204 and the front wheels or glides (not shown) of surface cleaning head 108 may allow surface cleaning unit 112 to roll away. By detaching surface cleaning unit 112 from surface cleaning head 108, surface cleaning unit 112 may be placed directly on the sloped surface. Optionally, additional accessory tools may be coupled to the upstream end 192 of the wand 180.

Optionally, one or more auxiliary support members, including for example a wheel and a roller, can be provided on the rear of the surface cleaning apparatus and/or the upper portion and configured to contact the floor (or other surface) when the upper portion is inclined or placed close to the surface. Providing an auxiliary support member may help carry some of the weight of the surface cleaning unit and/or upper portion when in a generally horizontal configuration. The auxiliary support member may also help the upper portion 104 and/or surface cleaning unit 112 to roll relatively easily over the floor when in a generally horizontal position. This may help a user to more easily maneuver the upper portion and/or surface cleaning unit under obstacles, such as a bed, cabinet or other piece of furniture.

Removable Cyclone

The following is a description of a removable cyclone that may be used by itself in any surface cleaning apparatus or in any combination or sub-combination with any other feature or features disclosed herein.

Reference is now made to FIGS. 8 and 9. Optionally, the cyclone bin assembly 136 may be detachable from the motor housing 132. Providing a detachable cyclone bin assembly 136 may allow a user to carry the cyclone bin assembly 136 to a garbage can for emptying, without needing to carry or move the rest of the surface cleaning apparatus 100 or the surface cleaning unit 112. Preferably, the cyclone bin assembly 136 can be separated from the motor housing 132 while the surface cleaning unit 112 is mounted on the upper portion 104 and also when the surface cleaning unit 112 is separated from the upper portion 104. FIG. 8 illustrates an embodiment where the cyclone bin assembly 136 is removable as a closed module, which may help prevent dirt and debris from spilling out of the cyclone bin assembly 136 during transport.

Optionally, as exemplified, removing the cyclone bin assembly 136 reveals a pre-motor filter chamber 208 that is positioned in the air flow path between the cyclone bin assembly 136 and the suction motor 128. One or more filters may be provided in the pre-motor filter chamber 208 to filter the air exiting the cyclone bin assembly 136 before it reaches the motor 128. In the illustrated example, the pre-motor filter includes at least a foam filter 212 positioned within the pre-motor filter chamber 208. Preferably, filter 212 is removable to allow a user to clean and/or replace the filter 212 when it is dirty. Optionally, part or all of the sidewalls of the pre-motor filter chamber or housing 208 can be at least partially transparent so that a user can visually inspect the condition of the filter 212 without having to remove the cyclone bin assembly 136.

In some embodiments, cyclone bin assembly 136 may extend below and partially surround pre-motor filter chamber 208. In the illustrated embodiment, cyclone bin assembly 136 includes a cyclone chamber 144 aligned above pre-motor filter chamber 208 and a dirt collection chamber 148 extending below and forward of pre-motor filter chamber 208. This may provide an enlarged dirt collection chamber 148 in a compact arrangement. In turn, the capacity of dirt collection chamber 148 may be increased which may permit surface cleaning apparatus 100 to be emptied less frequently. Still, in alternative embodiments, cyclone bin assembly 136 may be wholly positioned to one side of pre-motor filter chamber 208 (e.g. above pre-motor filter chamber 208).

Preferably, cyclone bin assembly 136 may be releasably connected to surface cleaning unit 112. For example, surface cleaning unit 112 may include a locking mechanism having a locked position, in which cyclone bin assembly 136 may be inhibited from separating from surface cleaning unit 112, and an unlocked position, in which cyclone bin assembly 136 may be freely removed from surface cleaning unit 112. As exemplified, cyclone bin assembly 136 includes a locking mechanism 216 for releasably securing cyclone bin assembly 136 to surface cleaning unit 112. In the example shown, locking mechanism 216 includes a locking member (or latch) 218 which may releasably engage a mating recess 220 in surface cleaning unit 112. Recess 220 may be sized and positioned to receive locking mechanism 216 when cyclone bin assembly 136 is positioned in place on surface cleaning unit 112. Locking mechanism 216 may interfere with the removal of cyclone bin assembly 136 from surface cleaning unit 112 by the interaction of locking member 218 with recess 220. For example, a groove provided on latch 218 may engage the wall in which recess 220 is located.

Locking mechanism 216 may also include a lock-release actuator 224 which may be activated to move locking mechanism 216 to the unlocked position. Preferably, lock-release actuator 224 may be located on or proximate to handle 226 of cyclone bin assembly 136 so it may be actuated by a user using the same had as is used to hold handle 226. This may permit a user to simultaneously grasp handle 226 and activate lock-release actuator 224. As exemplified, a rear portion of handle 226 includes a lock-release actuator 224. Activating lock-release actuator 224 may retract locking member 218 from recess 220 (e.g., by pivoting or rotating or translating latch 218 towards cyclone bin assembly 136) to place locking mechanism 216 in the unlocked position in which cyclone bin assembly 136 may be removed from surface cleaning unit 112.

Referring now to FIGS. 9 and 10, cyclone bin assembly 136 may include one or more of an openable lid or bottom. This may provide access to empty dirt collection chamber 148 and/or cyclone chamber 144. As exemplified, cyclone bin assembly 136 includes an openable lid 228. Lid 228 may be movable between a closed position (FIG. 9) in which lid 228 closes an upper end of cyclone bin assembly 136, and an open position (FIG. 10) in the upper end of cyclone bin assembly 136 is open.

Lid 228 of cyclone bin assembly 136 may be completely removed from cyclone bin assembly 136 in the open position. Alternatively, lid 228 may remain attached to cyclone bin assembly 136 in the open position. As exemplified, cyclone bin assembly 136 may include hinges 232 that pivotally connect lid 228 to cyclone bin assembly 136. This may permit lid 228 to pivot to an open position while conveniently remaining connected to cyclone bin assembly 136.

Bleed Valve

The following is a description of an adjustable bleed valve that may be used by itself in any surface cleaning apparatus or in any combination or sub-combination with any other feature or features disclosed herein.

Reference is now made to FIG. 1. In some embodiments, surface cleaning apparatus 100 may include one or more bleed valves. A bleed valve may be operable to provide a secondary air inlet into the airflow pathway between the dirty air inlet and the suction motor. For example, if an obstruction occurs at the dirty air inlet (e.g. a clog), the flow of air through the airflow pathway and the suction motor may decline. Where the suction motor relies upon this airflow for cooling, the reduced airflow may lead to overheating of the suction motor. In this case, a bleed valve may be opened to provide a secondary air inlet which may permit the suction generated by the suction motor to draw additional air through the bleed valve to the suction motor. This may help to prevent the suction motor from overheating.

A bleed valve may also be operable to modulate the level of suction developed at the dirty air inlet. Opening the bleed valve may reduce the suction at the dirty air inlet, and closing the bleed valve may restore the suction at the dirty air inlet. This may be useful for selecting a level of suction best suited to a surface to be cleaned. For example, low suction may be recommended for thick carpet and high suction may be recommended for hard floors. In some cases, the bleed valve may have multiple open positions (i.e. corresponding to different degrees of openness), each of which admits a different amount of air, for selecting from among multiple different levels of suction at the dirty air inlet. For example, the bleed valve may be set to a half-open position to draw medium suction for short carpet, or to a fully-open position to draw minimum suction for thick carpet. Further, the bleed valve may be continuously variable between closed and full-open which may allow for precise control of the amount of air admitted through the valve.

Preferably, surface cleaning apparatus 100 may include two bleed valves. A first bleed valve may be provided for preventing the suction motor from overheating, and the second bleed valve may be provided for adjusting the level of suction developed at the dirty air inlet based on the type of surface being cleaned. The first bleed valve may be configured to open and close automatically in response to the pressure and/or airflow in the air flow pathway and may be provided downstream of a pre-motor filter. For example, the first bleed valve may open automatically in response to pressure or airflow below a certain threshold.

The second bleed valve may be selectively operable by a user for setting the level of suction at the dirty air inlet (e.g. in accordance with the recommended level of suction for the surface to be cleaned). For example, the surface cleaning apparatus 100 may include a control member that is may be operatively connected to the second bleed valve by any means known in the art (e.g., electrically, mechanically, or electromechanically coupled to the bleed valve) for setting the position of the bleed valve (e.g. to an open, partially open or a closed position). Examples of suitable control members include dials, switches, levers, slides, buttons, and touch-screens. The bleed valve may be located at any position along the airflow pathway. For example, the bleed valve may provide a secondary air inlet at a portion of the airflow pathway provided by, e.g., the handle 160, wand 180 or hose 124.

Optionally, handle 160 may form part of the airflow pathway between dirty air inlet 116 and surface cleaning unit 112. For example, handle 160 may be interposed between wand 180 and hose 124. If handle 160 forms part of the airflow pathway, then the bleed valve may be part of handle 160. For example, the bleed valve may be internal of handle 160 (in which case handle 160 is provided with a grill or the like for the upstream side of the bleed valve to be in communication with the ambient air) or it may be located on an exterior portion (e.g., in a recess provided in the outer surface of handle 160). In such a case, the control for the bleed valve may be provided on handle 160 or remotely therefrom.

Alternatively, handle 160 may surround a portion of wand 180 and/or hose 124 without participating in the airflow pathway to the surface cleaning unit 112. In such a case, the control for the bleed valve may be provided on handle 160 and operatively controlled to the bleed valve. For example, the bleed valve may be provided in the hose or a hose cuff and operated by a control provided on handle 160.

Reference is now made to FIGS. 11, 12*a*-12*b* and 14*a*-14*b*. In the example shown, a bleed valve 2002 is located inside handle 160. Bleed valve 2002 may be any suitable valve. As exemplified, bleed valve 2002 may include a socket 2006 and a plug 2010. In the example shown, handle 160 forms part of the airflow pathway from the surface cleaning head 108 to hose 124 (FIG. 1). For example, handle 160 may include a conduit 2014 which may be in airflow communication with upstream hose 124 (FIG. 1). Socket 2006 may provide a secondary inlet to the airflow pathway in addition to primary inlet at, e.g., the dirty air inlet of the surface cleaning head or upstream end 200 of handle 160 if handle 160 is disconnected from wand 180. For example, socket 2006 may provide an opening into conduit 2014 to admit ambient air into the airflow pathway as exemplified by the arrows in FIG. 12*a*.

Bleed valve 2002 may include at least an open position in which air may be admitted into the airflow pathway through bleed valve 2002, and a closed position in which air is not permitted into the airflow pathway through bleed valve 2002. As exemplified, plug 2010 may be movable between an open position in which plug 2010 is spaced apart from socket 2006 as shown in FIG. 12*a*, and a closed position in which plug 2010 seals socket 2006 as shown in FIG. 12*b*. Preferably, handle 160 includes one or more vents 2022 as shown in FIG. 11 which allow ambient air to pass through handle 160 toward socket 2006 when bleed valve 2002 is in the open position. Optionally, socket 2006 may include a seal (e.g. O-ring) which may compress against socket 2006 to form an air-tight seal with socket 2006 when in the closed position.

A control member may be provided to manually operate bleed valve 2002. Preferably, the control member is located on or adjacent the handle 160 to provide easy user access while operating the surface cleaning apparatus 100. For example, the control member may be provided at a location that is operable by the same hand of a user that is user to move the surface cleaning head 108 using handle 160. Accordingly, for example, the control member may be provided on hand grip portion 182. In this way, a user may use, e.g., their thumb to adjust the control while vacuuming. Accordingly, if a user moves a surface cleaning head 108 from a hard floor to an area rug, the user may easily adjust the position of the bleed valve to an appropriate setting for the area rug while continuing to vacuum.

In the example shown, handle 160 includes a slider switch 2026. Slider switch 2026 is an example of a control member. Slider switch 2026 may be operably coupled to bleed valve 2002 to select the position of bleed valve 2002. For example, slider switch 2026 may include at least a first position shown in FIG. 12*a* which moves bleed valve 2002 to the open position, and a second position shown in FIG. 12*b* which moves bleed valve 2002 to the closed position.

The control member may be operably connected to bleed valve 2002 in any suitable manner. For example, the control member may be connected to bleed valve 2002 by an electrical, mechanical, or electromechanical connection. In the example shown, slider switch 2026 is mechanically coupled to bleed valve 2002 by a linkage 2030. For example, the bleed valve may comprise a plug 2010. Slider switch 2026, linkage 2030 and plug 2010 may be made as a one piece assembly, e.g., they made molded as a unit. And may me slidably mounted in handle 160 in a tack. Slider switch 2026 may be movable upwardly to the open position shown in FIG. 12*a*, which moves plug 2010 away from socket 2006, and may be movable downwardly to the closed position shown in FIG. 12*b*, which moves plug 2010 into socket 2006.

In some embodiments, the control member be positionable at one or more additional positions between the open position and the closed position. For example, slider switch 2026 may be positionable in one or more intermediate positions between the open (FIG. 12*a*) and closed positions (FIG. 12*b*). Each intermediate position of slider switch 2026 may move plug 2010 to a different distance from socket 2006 to admit a different amount of air to enter the airflow pathway. As exemplified, moving slider switch 2026 to an intermediate position closer to the openmost position of slider switch 2026 exemplified in FIG. 12*a* moves plug 2010 from inlet 2006 thereby allowing more air to enter the airflow pathway, and vice versa.

Optionally, handle 160 may include one or more visual markings, which may be provided adjacent slider switch 2026 (e.g., below slider switch 2026 in panel 2058 as exemplified in FIG. 11) which correspond to positions of the control member. For example, the visual markings may identify the positions of slider switch 2026 which are recommended for different floor cleaning surface types. Such markings may help to remind users of the recommended bleed valve setting for particular surface types. In some embodiments, handle 160 includes a THICK CARPET marking identifying the openmost position of slider switch 2026, a HARD FLOOR marking identifying the closed position of slider switch 2026, and a SHORT CARPET marking identifying an intermediate position of slider switch 2026.

Brush Speed Selector

The following is a description of a brush speed selector that may be used by itself in any surface cleaning apparatus or in any combination or sub-combination with any other feature or features disclosed herein.

Reference is now made to FIG. 13. In some embodiments, surface cleaning apparatus 100 includes an electrically powered peripheral device, other than a suction motor. For example, surface cleaning head 108 may include a powered brush 2034, e.g., a rotatable brush. Powered brush 2034 may include a plurality of bristles 2038 or the like which are driven by a brush drive (e.g. an electric brush drive motor, not shown) to rotate about an axis of rotation 2042. In use, bristles 2038 may be positioned to contact the surface to be cleaned, in order to dislodge and collect dirt and hair. The brush drive motor may be drivingly connected to the brush by any means known in the surface cleaning arts, such as a belt drive or direct drive.

Generally, it is recommended to use a power brush on certain surface types, such as carpet which may retain dirt and hair more persistently, and to disable the power brush for certain other surface types, such as hard surfaces (e.g. hardwood or tiles) where the bristles may deflect dirt away from the dirty air inlet or scratch the surface. Further, it may be recommended to change the speed of the power brush (i.e. the rotary speed of the bristles) to a faster speed for certain surface types (e.g. thick carpet) than for other surface types (e.g. short carpet).

Reference is now made to FIGS. 11, 12*a*-12*b* and 14*a*-14*b*. In some embodiments, the surface cleaning apparatus 100 may include a control member operably connected to adjust the speed of the brush. The control member may be operably connected to the brush drive motor or to a transmission member positioned between the brush drive motor and the brush to selectively activate and/or control the speed of the power brush. This may permit a user to selectively activate, deactivate, speed up or slow down the power brush according to the surface type to be cleaned. The control member may be mechanically, electrically, or electromechanically coupled to the brush drive controlling the speed of the power brush. Examples of suitable control members include dials, switches, levers, slides, buttons, and touchscreens.

As exemplified, handle 160 includes a slider switch 2026. Slider switch 2026 is an example of a suitable control member. Slider switch 2026 may be electrically connected to the brush drive of power brush 2034 in any suitable manner, such as by way of an electrical connector 2046. As exemplified in FIG. 5, when handle 160 is inserted into wand 180, electrical connector 2046 is electrically connected to a socket provided inside wand 180. The inlet end 192 of wand 180 is provided with electrical connector 1088 (that is electrically connected to the socket in the upper end of wand 180). Electrical connector 1088 is electrically connected to a socket provided inside upper end 104 when wand 180 is inserted therein. The brush drive (e.g., the brush motor) is electrically connected to the socket in upper portion 104. Therefore, when assembled as exemplified in FIG. 1, slider switch is electrically connected to, e.g., the brush drive motor.

In the example shown, slider switch 2026 is movable between at least an off position as shown in FIGS. 12*b* and 14*b* and a high speed position as shown in FIGS. 12*a* and 14*a*. Optionally, slider switch 2026 may include one or more selectable positions between the off and high speed positions shown, such as a medium speed or very high speed. In some embodiments, slider switch 2026 is infinitely positionable between the off and high speed positions shown for selecting a speed within a continuous spectrum from off to high speed. In use, a user may move slider switch 2026 from the off position to any other non-zero speed position to operate the power brush at a selected speed.

Any control means known in the art may be used to enable the movement of slider switch 2026 to adjust the rate of rotation of the brush, e.g., varying the power delivered to the brush drive motor, adjusting the speed setting of the brush drive motor if the brush drive motor has variable speed settings and adjusting the adjusting the setting or a transmission.

As discussed previously, the control member may be positioned anywhere on surface cleaning apparatus 100. Preferably, the control member is positioned on handle 160. As exemplified, slider switch 2026 is positioned on handle 160. This may provide easy access for a user to control the power brush during use, such as by changing the position of slider switch 2026, as the cleaning surface type changes.

In some embodiments, visual markings may be provided adjacent slider switch 2026 which communicate a correspondence between the different positions of slider switch 2026 and the speed of power brush 2034. For example, visual markings may be provided for OFF, LOW SPEED, and HIGH SPEED. Alternatively or in addition, the visual markings may communicate a correspondence between the different positions of slider switch 2026 and the recommended surface type for the corresponding speed. For example, visual markings may be provided for HARD FLOOR (at the off position), SHORT CARPET (at the medium speed position), and THICK CARPET (at the high speed position).

Combination Bleed Valve and Brush Speed Selector

The following is a description of a combination adjustable bleed valve and brush speed selector that may be used by itself in any surface cleaning apparatus or in any combination or sub-combination with any other feature or features disclosed herein.

In some embodiments, surface cleaning apparatus may include both the manually operable bleed valve and the brush speed selector as discussed separately herein. In such an embodiment, each of the manually operable bleed valve and the brush speed selector may have their own individual control.

Preferably, one control member may be used to control both the position (i.e. openness) of the bleed valve, and the brush speed of the power brush. This may permit a user to use one control member to adjust the suction developed at the dirty air inlet and the brush speed of the power brush. In the example shown, slider switch 2026 is mechanically coupled to bleed valve 2002, and electrically connected to the brush drive (not shown) of power brush 2034.

Each position of the control member may therefore simultaneously correspond to a pair of settings: a bleed valve position and a power brush speed. Adjusting the position of the control member may automatically change both the bleed valve position and the power brush speed according to the corresponding pair of settings. In some embodiments, each pair of settings may correspond to settings that recommended for a particular cleaning surface type. For example, it may be recommended when cleaning hard flooring that the bleed valve should be closed and the power brush should be turned off. Accordingly, there may be a position on the control member for closing the bleed valve and turning off the power brush. As exemplified, when slider switch 2026 is moved to the lowest position shown in FIG. 12*b*, the bleed valve 2002 may be fully closed and the power brush 2034 may be turned off.

In another example, it may be recommended when cleaning thick carpet that the bleed valve should be fully open and the power brush speed should be set to maximum. Accordingly, there may be a position on the control member for fully opening the bleed valve and setting the power brush speed to maximum. As exemplified, when slider switch 2026 is moved to the uppermost position shown in FIG. 12*a*, the bleed valve 2002 may be fully open and the speed of the power brush 2034 may be set to maximum.

The control member may be positioned anywhere on surface cleaning apparatus 100. Preferably, the control member is positioned on handle 160. As exemplified, slider switch 2026 is positioned on hand grip portion 182 of handle 160. This may provide easy access for a user to control the power brush and bleed valve during use, such by changing the position of the control member, as the cleaning surface type changes.

If visual markings are provided, which are preferably located adjacent the control member, then the markings may be used to communication a recommended position of the control member based on the type of surface being cleaned. Therefore, a user need not consider whether a high or low brush speed is needed or an open or closed position of the bleed valve is needed. Instead, the user may move the control member to position corresponding to the floor type being cleaned, e.g., HARD FLOOR, SHORT CARPET, and THICK CARPET and the positioning of the control member in the selected position will automatically adjust the speed of the brush and the position of the bleed valve to the recommended positions corresponding to the selected position of the control member.

It will be appreciated that other visual markings may be provided, such as OFF, LOW SPEED, and HIGH SPEED in regards to the power brush speed and/or CLOSED, PARTIALLY CLOSED, and OPEN in regards to the position of the bleed valve 2002.

Brush Groove for Hair Removal

The following is a description of a brush groove for hair removal that may be used by itself in any surface cleaning apparatus or in any combination or sub-combination with any other feature or features disclosed herein.

Surface cleaning head 108 may include a rotating brush, such as a power brush, to help dislodge dirt from the cleaning surface, and to help move the dirt into the dirty air inlet. Hair is a common form of dirt found on a cleaning surface. Often, a rotating brush can collect hair that becomes wound or otherwise entangled on the rotating brush. Over time, the entangled hairs may affect the performance of the surface cleaning apparatus. For example, the entangled hairs may interfere with the rotation of the rotating brush, or obstruct the dirty air inlet.

Reference is now made to FIG. 13. In some embodiments, surface cleaning head 108 may include a brush having a brush groove for cutting hairs off of the brush. In use, a user may run a sharp blade across the brush groove, or along the groove under the hair to slice the hairs for removal from the brush. As exemplified, surface cleaning head 108 includes a rotating power brush 2034. Power brush 2034 may include a rotating base 2050 or core from which bristles 2038 extend outwardly. Rotating base 2050 may be driven by a brush drive (not shown) to rotate about an axis of rotation 2042.

Rotating base 2050 may be susceptible to collecting hairs that become wound as base 2050 rotates. As shown, rotating base 2050 may include one or more grooves 2054. Preferably, each groove 2054 extends substantially laterally (i.e. in the direction of axis 2042) across base 2050. Although only one groove 2054 is exemplified, base 2050 may include a plurality of grooves 2054 (e.g. positioned around the circumference of base 2050) which may extend from one end of the brush to the other or each may extend part way along the axial length of the brush. In use, a user may run a sharp blade across groove 2054 to cut hairs entangled around base 2050. For example, the user may position the blade so that the blade extends out of groove 2054 at one end of base 2050, and then pull the blade along groove 2054 to the opposite end of base 2050 thereby cutting the intervening hairs. Afterwards, the cut hair segments may be easily removed from power brush 2034.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A surface cleaning apparatus comprising:

a surface cleaning head having a dirty air inlet;

an upper portion moveably mounted to the surface cleaning head between a storage position and a floor cleaning position;

a portable surface cleaning unit comprising a suction motor and an air treatment member removably mounted to the upper portion;

an above floor cleaning wand removably mounted to the upper portion and comprising a lower end and an upper end;

a flexible air flow conduit forming at least part of an air flow path from the above floor cleaning wand to the surface cleaning unit; and, a handle provided proximate the upper end of the wand and drivingly connected to the surface cleaning head when the wand is mounted to the upper portion, the handle comprising a bleed valve, wherein the bleed valve is positionable in a plurality of different open positions, and wherein differing amounts of bleed air are admitted when the bleed valve is in the different open positions.

2. The surface cleaning apparatus of claim 1 further comprising a control member operable between a plurality of positions and the position of the bleed valve is adjusted by adjustment of the control member to a different operating position.

3. The surface cleaning apparatus of claim 2 wherein the control member comprises a manually operable member.

4. The surface cleaning apparatus of claim 2 wherein the control member is operatively connected to a brush drive motor that is provided in the surface cleaning head, the brush drive motor is operable in at least two operating modes comprising at least two of a high speed mode, a low speed mode and an off mode in which a brush driven by the brush motor does not rotate, and the control member is operable to adjust the mode of the brush drive motor wherein the position of the bleed valve is automatically adjusted when the control member adjusts the operating mode of the brush drive motor.

5. The surface cleaning apparatus of claim 4 wherein the amount of bleed air that is admitted is selected based on the operating mode of the brush drive motor.

6. The surface cleaning apparatus of claim 4 wherein the position of the bleed valve is pre-determined based on the position of the control member.

7. The surface cleaning apparatus of claim 4 wherein the bleed valve is automatically adjusted to admit less bleed air as the brush drive motor is adjusted to operate at a lower speed.

8. An upright surface cleaning apparatus comprising:

a surface cleaning head having a dirty air inlet, a brush and a brush drive motor;

a handle drivingly connected to the surface cleaning head;

a bleed valve positioned proximate the handle and having a plurality of open positions; and, a control member positioned proximate the handle and operable between a plurality of positions corresponding to the open positions of the bleed valve and the position of the bleed valve is adjusted by adjustment of the control member to a different operating position.

9. The upright surface cleaning apparatus of claim 8 wherein the control member is operable by a user when the user is using the handle to direct the surface cleaning head.

10. The surface cleaning apparatus of claim 8 wherein the control member comprises a manually operable member that is positionable in a plurality of positions and the bleed valve is adjusted to one of the plurality of open positions to admit differing amounts of bleed air by adjustment of the control member to a different operating position.

11. The surface cleaning apparatus of claim 10 wherein the position of the bleed valve is pre-determined based on the position of the control member.

12. The surface cleaning apparatus of claim 8 wherein the control member is operatively connected to the brush drive motor, the brush drive motor is operable in at least two operating modes comprising at least two of a high speed mode, a low speed mode and an off mode in which a brush driven by the brush motor does not rotate, and the control member is operable to adjust the mode of the brush drive motor wherein the position of the bleed valve is automatically adjusted when the control member adjusts the operating mode of the brush drive motor, whereby the amount of bleed air that is admitted is selected based on the operating mode of the brush drive motor.

13. The surface cleaning apparatus of claim 8 wherein the control member is operatively connected to the brush drive motor and the bleed valve is automatically adjusted to admit less bleed air as the brush drive motor is adjusted to operate at a lower speed.

14. A surface cleaning apparatus comprising:

a surface cleaning head having a dirty air inlet, a brush and a brush drive motor, the brush drive motor is operable in at least two operating modes comprising at least two of a high speed mode, a low speed mode and an off mode in which a brush driven by the brush motor does not rotate;

a handle assembly drivingly connected to the surface cleaning head;

a body housing a bleed valve that is positionable in a plurality of different positions; and, a control member operatively connected to the brush drive motor and operable to adjust the mode of the brush drive motor wherein the position of the bleed valve is automatically adjusted when the control member adjusts the operating mode of the brush drive motor.

15. The surface cleaning apparatus of claim 14 wherein the position of the bleed valve is pre-determined based on the position of the control member.

16. The surface cleaning apparatus of claim 14 wherein the control member is operatively connected to the brush drive motor and the bleed valve is automatically adjusted to admit less bleed air as the brush drive motor is adjusted to operate at a lower speed.

17. The upright surface cleaning apparatus of claim 14 wherein the control member is operable by a user when the user is using the handle assembly to direct the surface cleaning head.

18. The upright surface cleaning apparatus of claim 17 wherein the handle assembly comprises an above floor cleaning wand and removable with the wand for above floor cleaning.

19. The upright surface cleaning apparatus of claim 17 wherein the bleed valve is part of a handle of the handle assembly.

* * * * *